US006074543A

United States Patent [19]

Yoshihira et al.

[11] Patent Number: 6,074,543

[45] Date of Patent: Jun. 13, 2000

[54] METHOD FOR PRODUCING LIQUID EJECTING HEAD

[75] Inventors: Aya Yoshihira, Yokohama; Hiroshi Sugitani, Machida; Tadayoshi Inamoto, Hachioji; Makiko Kimura, Sagamihara; Toshio Kashino, Chigasaki; Shuji Koyama, Kawasaki; Takeshi Okazaki, Sagamihara; Kiyomitsu Kudo, Yokohama; Yoshie Nakata, Kawasaki; Toshihiro Mori, Yokohama, all of Japan

[73] Assignee: Canon Kabushiki Kaisha, Tokyo, Japan

[21] Appl. No.: 08/632,097

[22] Filed: Apr. 15, 1996

[30] Foreign Application Priority Data

| | | | |
|---|---|---|---|
| Apr. 14, 1995 | [JP] | Japan | 7-089058 |
| Apr. 26, 1995 | [JP] | Japan | 7-127316 |
| Apr. 26, 1995 | [JP] | Japan | 7-127318 |
| Apr. 26, 1995 | [JP] | Japan | 7-127319 |
| Jun. 2, 1995 | [JP] | Japan | 7-136863 |
| Jun. 8, 1995 | [JP] | Japan | 7-142214 |
| Jun. 22, 1995 | [JP] | Japan | 7-156536 |
| Sep. 4, 1995 | [JP] | Japan | 7-226871 |
| Apr. 15, 1996 | [JP] | Japan | 8-092186 |

[51] Int. Cl.[7] ..... C25D 1/08

[52] U.S. Cl. ..... 205/75; 205/78; 29/611; 29/890.1; 216/27; 347/65

[58] Field of Search ..... 29/611, 890.1; 205/68, 78, 75, 69; 216/27; 347/47, 65

[56] References Cited

U.S. PATENT DOCUMENTS

| | | | |
|---|---|---|---|
| 4,480,259 | 10/1984 | Kruger et al. | 346/140 R |
| 4,487,662 | 12/1984 | Fischbeck | 29/890.16 |
| 4,496,960 | 1/1985 | Fischbeck | 347/68 |
| 4,509,063 | 4/1985 | Sugitani et al. | 346/140 R |
| 4,558,333 | 12/1985 | Sugitani et al. | 346/140 R |

(List continued on next page.)

FOREIGN PATENT DOCUMENTS

| | | | |
|---|---|---|---|
| 0436047 | 7/1991 | European Pat. Off. . | |
| 0443798 | 8/1991 | European Pat. Off. . | |
| 479441 | 4/1992 | European Pat. Off. | 29/890.1 |
| 0605006 | 7/1994 | European Pat. Off. . | |
| 61-59914 | 2/1980 | Japan . | |
| 55-81172 | 6/1980 | Japan . | |
| 61-69467 | 4/1986 | Japan . | |

(List continued on next page.)

*Primary Examiner*—P. W. Echols

*Attorney, Agent, or Firm*—Fitzpatrick, Cella, Harper & Scinto

[57] ABSTRACT

A method to produce a liquid ejecting head having an ejection outlet for ejecting a liquid, a heat generating element for applying thermal energy to the liquid, a liquid flow path comprised of a first path portion in fluid communication with the ejection outlet and a second path portion disposed below the first path portion and provided with the heat generating element in a bottom surface thereof, a partition wall for partitioning the liquid flow path into the first path portion and second path portion, and a movable member disposed above the heat generating element in the portion wall and arranged as displaceable to a side of the first path portion in accordance with a bubble generated in the liquid by the thermal energy in which upon generation of the bubble the first path portion and the second path portion are in fluid communication with each other and the pressure is directed toward said ejection outlet by the movable member displaced to eject the liquid droplet. The method comprises a step of preparing a substrate provided with the heat generating element, a step of forming a grooved partition wall having the movable member and side walls of the second path portion, and a step of joining the grooved partition wall to the substrate to form the second path portion.

2 Claims, 21 Drawing Sheets

U.S. PATENT DOCUMENTS

| | | | |
|---|---|---|---|
| 4,611,219 | 9/1986 | Sugitani et al. | 346/140 R |
| 4,654,676 | 3/1987 | Itano et al. | 216/27 |
| 4,698,645 | 10/1987 | Inamoto | 346/140 R |
| 4,723,129 | 2/1988 | Endo et al. | 346/1.1 |
| 4,839,001 | 6/1989 | Bakewell | 205/75 |
| 5,262,802 | 11/1993 | Karita et al. | 346/140 R |
| 5,278,585 | 1/1994 | Karz et al. | 346/140 R |
| 5,389,957 | 2/1995 | Kimura et al. | 347/20 |
| 5,485,184 | 1/1996 | Nakagomi et al. | 347/63 |

FOREIGN PATENT DOCUMENTS

| | | | |
|---|---|---|---|
| 61-110557 | 5/1986 | Japan | B41J 3/04 |
| 62-156969 | 7/1987 | Japan | B41J 3/04 |
| 62-48585 | 10/1987 | Japan . | |
| 63-197652 | 8/1988 | Japan | 29/890.1 |
| 63-199972 | 8/1988 | Japan | F16K 15/14 |
| 2-113950 | 4/1990 | Japan . | |
| 3-81155 | 4/1991 | Japan | B41J 2/05 |
| 5-124189 | 5/1993 | Japan | B41J 2/05 |
| 5-229122 | 9/1993 | Japan . | |
| 6-31918 | 2/1994 | Japan | B41J 2/05 |
| 6-87214 | 3/1994 | Japan | B41J 2/05 |

METHOD FOR PRODUCING LIQUID EJECTING HEAD

BACKGROUND OF THE INVENTION

1. Field of the Invention

The present invention relates to a method for producing a liquid ejecting head for ejecting a desired liquid by generation of a bubble with application of thermal energy to the liquid. More particularly, the invention relates to a method for producing a liquid ejecting head using a movable member which is constructed so as to be displaced in response to the generation of a bubble. Further, the present invention concerns a liquid ejecting head, a head cartridge using the liquid ejecting head, a liquid ejecting apparatus, and a head kit.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

2. Related Background Art

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method generally comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be located at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

For such a bubble jet recording method, a proposal was made to employ a structure incorporating a movable member such as a valve or the like in a flow path in order to improve the ejection efficiency.

For example, Japanese Laid-Open Patent Application No. 63-199972 describes a method for producing valve elements in an ink jet recording head with valves in flow paths.

In this publication patterns of the valves are formed by photolithography of a photosensitive resin or the like.

Further, Japanese Laid-Open Patent Application No. 63-197652 describes a method for producing valves in an ink jet recording head with check valves provided on the upstream side of the flow paths.

In this publication, the valves are integrally formed with a substrate, utilizing parts of the substrate, by photolithography.

Japanese Laid-Open Patent Application No. 6-31918 (U.S. Pat. No. 5,278,585) discloses a method for producing an ink jet head having one-way valves. This is the method for producing the ink jet head having a silicon substrate and movable members patterned by photolithography and processed by anisotropic etching. This publication also discloses a method for forming the movable members of a silicon dioxide layer in the silicon substrate, a method for forming the movable members in a surface region of a silicon wafer by implantation or diffusion of boron, a method for forming the movable members by patterned etching stop occurring because of implantation of boron, and so on.

As the background art of the present invention there was a background art subject to enhance the fundamental ejection characteristics up to a conventionally unexpected level, from a conventionally inconceivable standpoint, in the basically conventional method for ejecting the liquid by forming a bubble (particularly, a bubble formed by film boiling) in a liquid flow path.

With this background art subject, some of the present inventors came to find that the most significant factor to considerably improve the ejection characteristics was to take account of a growing component downstream of the bubble, based on the consideration of influence of energy given by the bubble per se on an ejection amount. Namely, it was found that the ejection efficiency and ejection speed could be improved by efficiently directing the component downstream of bubble into a direction of ejection. Based on this finding, the inventors came to an extremely high technical level, when compared with the conventional technical level, to positively move the downstream component of bubble to the free end side of the movable member.

Further, it was also found that it was preferred to take account of structural elements such as the movable member and liquid flow path related to growth of bubble on the downstream side in a heating region for forming the bubble, for example, on the downstream side from the center line passing the center of the area of an electrothermal transducer in the direction of flow of liquid, or at the center of the area of a surface contributing to bubble generation.

Based on the above findings, some of the present inventors invented and already proposed a liquid jet head of an utterly novel structure.

This head has a first path portion in fluid communication with an ejection outlet, a second path portion with an electrothermal transducer provided therein, and a partition wall disposed between the first path portion and the second path portion and having a movable member arranged as displaceable to the first path portion side, in which the first path portion becomes in fluid communication with the second path portion when the movable member is displaced.

This head is arranged to effect ejection in such a way that a bubble is generated through drive of the electrothermal transducer, the movable member comes to be displaced to the first path portion side with growth of the bubble, and the pressure thereof is guided toward the ejection outlet by the movable member displaced.

In the liquid ejecting head using the movable member displaced depending upon the bubble as described above, the head is produced by positioning, jointing and securing through a press (stop) spring a substrate having the electrothermal transducer, side walls of the second path portion, the partition wall having the movable member, a grooved top plate having side walls of the first path portion.

In the above method for producing the liquid ejecting head, a gap, however, may sometimes occur between the partition wall and the second path portion walls because of variations in production. This is not easily checked depending on manufacture control. If the space appeared in this region the pressure for discharging the bubble might escape through this gap so as to cause ejection failure due to insufficient ejection pressure. Since the pressure wave escaping through the gap propagated into adjacent flow paths and fluctuated the liquid therein, variations of ejection amounts might sometimes occur upon continuous drive. A conceivable means for avoiding the occurrence of the gap is to bond the partition wall with the second path portion walls with an adhesive, but it is not preferred because in that case the adhesive could intrude into the space between the movable member and the partition wall so as to disable movement of the movable member.

Further, the above producing method needs positioning among the substrate, the partition wall, and the grooved top plate, so that it takes a lot of time for securing the positioning accuracy.

SUMMARY OF THE INVENTION

In view of the background art subject as described above, a specific object of the present invention is to provide a method for producing a movable member, capable of effectively and usefully regulating growth of bubble, applicable to general valves or the new head and the ejection principle described in the prior application filed by the present inventors.

More particularly, a first object of the present invention is to provide a method for producing a head and an apparatus which are easily and cheaply produced with high accuracy and which realize an ideal configuration for the above ejection principle, by constructing the liquid guide paths for supplying a plurality of liquids, of a reduced number of parts.

A second object of the present invention is to provide a production method for realizing a head in an ideal configuration for the above ejection principle and further to provide a production method improved in production cost and accuracy up to the level of commercial products.

Typical features of the present invention for achieving the above objects are as follows.

According to an aspect of the present invention, there is provided a method for producing a liquid ejecting head having an ejection outlet for ejecting a liquid, a heat generating element for applying thermal energy to said liquid, a liquid flow path consisting of a first path portion in fluid communication with said ejection outlet and a second path portion located below said first path portion, in a bottom surface of which said heat generating element is positioned, a partition wall for partitioning said liquid flow path into said first path portion and, second path portion, and a movable member in said partition wall disposed above said heat generating element so as to be displaceable to a side of the first path portion in accordance with a bubble generated in the liquid by said thermal energy, in which upon generation of said bubble the first path portion is in fluid communication with the second path portion and the pressure is directed toward said ejection outlet by said movable member displaced to eject the liquid droplet, said method comprising a step of preparing a substrate provided with said heat generating element, a step of forming a grooved partition wall having said movable member and side walls of said second path portion, and a step of joining said grooved partition wall to said substrate to form said second path portion.

According to another aspect of the present invention, there is provided a method for producing a liquid ejecting head having an ejection outlet for ejecting a liquid, a heat generating element for applying thermal energy to said liquid, a liquid flow path consisting of a first path portion in fluid communication with said ejection outlet and a second path portion located below said first path portion, in a bottom surface of which said heat generating element is positioned, a partition wall for partitioning said liquid flow path into said first path portion and second path portion, and a movable member disposed above said heat generating element in said partition wall so as to be displaceable to a side of the first path portion in accordance with a bubble generated in the liquid by said thermal energy, in which upon generation of said bubble the first path portion is in fluid communication with the second path portion and the pressure is directed toward said ejection outlet by said movable member displaced to eject the liquid droplet, wherein said movable member is formed by providing said partition wall with a slit and the slit of said movable member is formed by making said partition wall by electroforming.

According to a further aspect of the present invention, there is provided a method for producing a liquid ejecting head, having an ejection outlet for ejecting a liquid, a heat generating element for applying thermal energy to said liquid, a liquid flow path consisting of a first path portion in fluid communication with said ejection outlet and a second path portion located below said first path portion, in a bottom surface of which said heat generating element is positioned, a partition wall for partitioning said liquid flow path into said first path portion and second path portion, and a movable member disposed above said heat generating element in said partition wall so as to be displaceable in accordance with a bubble generated in the liquid by said thermal energy, wherein said movable member is formed by providing said partition wall with a slit and the slit of said movable member is formed by making said partition wall by electroforming.

According to a further aspect of the present invention, there is provided a liquid ejecting head having an ejection outlet for ejecting a liquid, a heat generating element for applying thermal energy to said liquid, a liquid flow path consisting of a first path portion in fluid communication with said ejection outlet and a second path portion located below said first path portion, in a bottom surface of which said heat generating element is positioned, a partition wall for partitioning said liquid flow path into said first path portion and second path portion, and a movable member disposed above said heat generating element in said partition wall so as to be displaceable to a side of the first path portion in accordance with a bubble generated in the liquid by said thermal energy, in which upon generation of said bubble the first path portion is in fluid communication with the second path portion and the pressure is directed toward said ejection outlet by said movable member displaced to eject the liquid droplet, wherein the partition wall provided with said movable member is integrally formed with side walls of the second path portion.

According to a further aspect of the present invention, there is provided a head cartridge having the liquid ejecting head as described above and a liquid container.

According to a further aspect of the present invention, there is provided a liquid ejecting apparatus having the liquid ejecting head as described above and driving signal supply means for supplying a driving signal for ejecting the liquid from the liquid ejecting head.

According to a further aspect of the present invention, there is provided a liquid ejecting apparatus having the liquid ejecting head as described above and recording medium carrying means for carrying a recording medium for receiving the liquid ejected from the liquid ejecting head.

According to a further aspect of the present invention, there is provided a head kit comprising the liquid ejecting head as described above and a liquid container for containing the liquid to be supplied to the liquid ejecting head.

According to a further aspect of the present invention, there is provided a head kit having the liquid ejecting head as described above, a liquid container for containing the liquid to be supplied to the liquid ejecting head, and liquid filling means for filling the liquid into the liquid container.

According to a further aspect of the present invention, there is provided a recorded material having received an ink ejected as the liquid by the liquid ejection recording method as described above.

The above characteristic features of the present invention enabled the movable member, capable of effectively and usefully regulating growth of a bubble for general valves or the ejection principle of the novel head described in the prior application, to accurately produced at low cost and with a reduced number of parts at the level of practical use as commercial products, and provided the head to exhibit the maximum effect also in the conventional ejection principle.

In more detail, by preliminarily integrally forming the partition wall having the movable member with the walls of the second path portion, no gap will possibly be formed between the partition wall and the walls of the second path portion, and a number of steps in manufacturing the liquid ejecting head can be decreased, thus improving the manufacturing throughput.

Further, since the slit width or the like can be precisely processed by forming the partition wall and the movable member separated in the predetermined slit width from the partition wall by electroforming, the ejecting liquid can accurately be ejected by a desired amount by displacing the movable member in accurate response to the pressure raised by bubble generation of the liquid receiving heat from the electrothermal transducer, which permits formation of high-quality image.

The other effects of the present invention will be understood from the description of the embodiments.

In the specification, the terms "upstream" and "downstream" are defined with respect to a general liquid flow from a liquid supply source through the liquid flow paths to the ejection outlet or are expressed as expressions as to the direction in this structure.

Further, a "downstream side" portion of the bubble itself represents an ejection-outlet-side portion of the bubble which directly functions mainly to eject a liquid droplet. More particularly, it means a downstream portion of the bubble in the above flow direction or in the direction of the above structure with respect to the center of the bubble, or a bubble appearing in the downstream region from the center of the area of the heat generating element.

In this specification, "substantially sealed" generally means a sealed state in such a degree that when a bubble grows, the bubble does not escape through a gap (slit) around the movable member before motion of the movable member.

In this specification, "partition wall" may mean a wall (which may include the movable member) interposed to separate the region in direct fluid communication with the ejection outlet from the bubble generation region, and more specifically means a wall separating the liquid flow path including the bubble generation region from the liquid flow path in direct fluid communication with the ejection outlet, thereby preventing mixture of the liquids in the respective liquid flow paths.

DESCRIPTION OF THE PREFERRED EMBODIMENTS (Explanation of the principle)

The ejection principle applicable to the present invention will be explained with reference to the drawings.

Figure 20A:
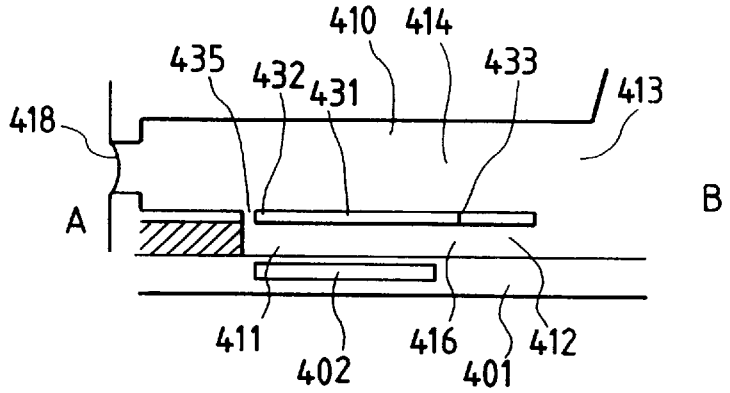
FIGS. 20A to 20D are schematic drawings to show an example of a liquid jet head achieving the novel ejection principle applicable to the present invention.
Figure 20B:
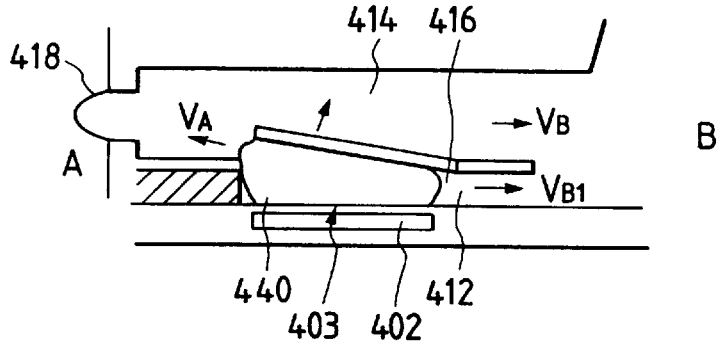
Figure 20C:
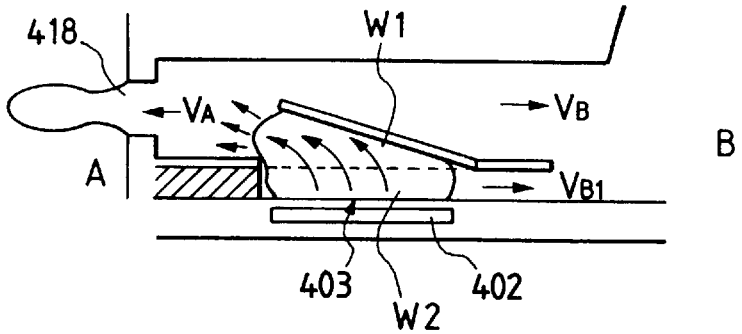
Figure 20D:
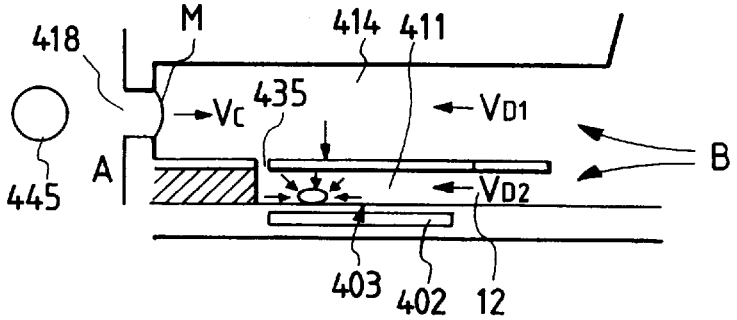
Figure 21:
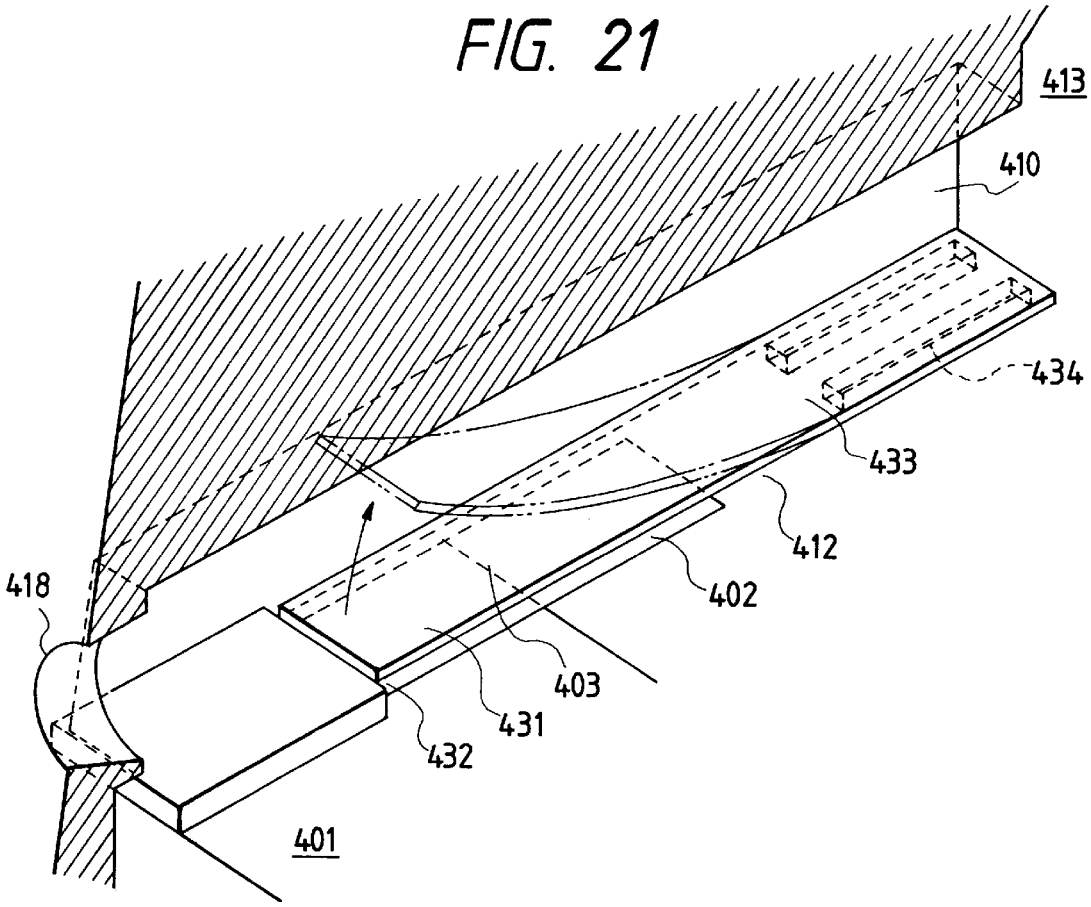
FIG. 21 is a partly broken, sectional view of the liquid jet head of FIGS. 20A to 20D.

FIGS. 20A to 20D are schematic cross-sectional views of the liquid discharge head taken along the direction of the liquid flow path and FIG. 21 is a partially broken perspective view of the liquid head.

The liquid ejecting head as shown in FIGS. 20A to 20D comprises a heat generating element 402 provided on an element substrate 401 (a heat generating resistor of 40 $\mu$m×105 $\mu$m in this embodiment) as the ejection energy generating element for supplying thermal energy to the liquid to eject the liquid, and a liquid flow path 410 formed above the element substrate 401 correspondingly to the heat generating element 402. The liquid flow path 410 is in fluid communication with a discharge port 418 and a common liquid chamber 413 for supplying the liquid to a plurality of such liquid flow paths 410 which is in fluid communication with a plurality of the ejection outlets 418.

Above the element substrate 401 in the liquid flow path 410, a movable member or plate 431 having a planer portion in the form of a cantilever of an elastic material such as metal is provided faced to the heat generating element 402. One end of the movable member 431 is fixed to a foundation (supporting member) 434 or the like provided by patterning of photosensitivity resin material on the wall of the liquid flow path 410 or the element substrate 401. By this structure, the movable member 431 is supported, and a fulcrum 433 (fulcrum portion) is constituted.

The movable member 431 is so positioned that it has a fulcrum 433 (fulcrum portion which is a fixed end) in an upstream side with respect to a great flow of the liquid from the common liquid chamber 413 toward the ejection outlet 418 through the movable member 431 caused by the ejecting operation and that it has a free end (free end portion) 432 in a downstream side of the fulcrum 433. Accordingly, the movable member 431 is faced to the heat generating element 402 with a gap of 15 $\mu$m approx so that it covers the heat generating element 402. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 410 is divided by the movable member 431 into a first liquid flow path 414 which is directly in communication with the ejection outlet 418 and a second liquid flow path 416 having the bubble generation region 411 and the liquid supply port 412.

By causing heat generation of the heat generating element 402, the heat is applied to the liquid in the bubble generation region 411 between the movable member 431 and the heat generating element 402, by which a bubble is generated in the liquid by the film boiling phenomenon as disclosed in U.S. Pat. No. 4,723,129. The bubble and the pressure caused by the generation of the bubble act mainly on the movable member, so that the movable member 431 moves or displaces to widely open toward the ejection outlet side about the fulcrum 433, as shown in FIGS. 20B and 20C or in FIG. 21. By the displacement of the movable member 431 or the state after the displacement, the propagation of the pressure caused by the generation of the bubble and the growth of the bubble per se are directed toward the ejection outlet.

Here, one of the fundamental ejection principles according to the present invention will be described. One of the important principles of this invention is that the movable member disposed faced to the bubble is displaced from the normal first position to the displaced second position on the basis of the pressure of the bubble generation or the bubble per se, and the displacing or displaced movable member 431 is effective to direct the pressure produced by the generation of the bubble and/or the growth of the bubble per se toward the downstream in which the ejection outlet 418 is located.

Figure 22:
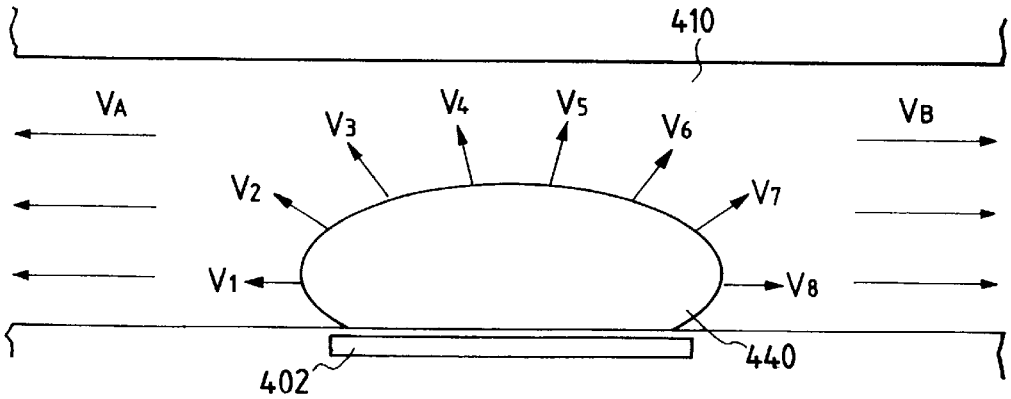
FIG. 22 is a schematic drawing to show a state of pressure propagation from a bubble in the conventional ejection principle.
Figure 23:
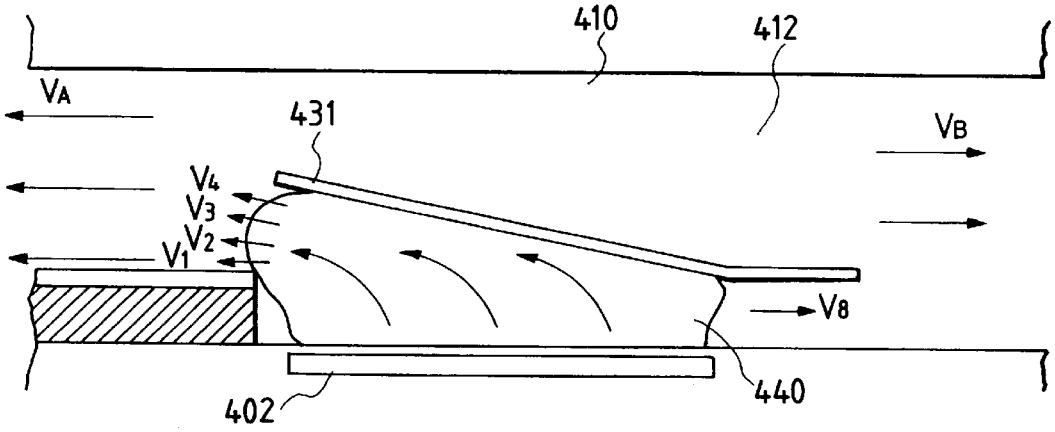
FIG. 23 is a schematic drawing to show a state of pressure propagation from a bubble in the novel ejection principle applicable to the present invention.

More detailed description will be made with comparison between the conventional liquid flow passage structure not using the movable member (FIG. 22) and the present invention (FIG. 23). Here, the direction of propagation of the pressure toward the ejection outlet is indicated by VA, and the direction of propagation of the pressure toward the upstream is indicated by VB.

In a conventional head as shown in FIG. 22, there is not any structural element effective to regulate the direction of the propagation of the pressure produced by the bubble 440 generation. Therefore, the direction of the pressure propagation is normal to the surface of the bubble as indicated by V1–V8, and therefore, is widely directed in the passage. Among these directions, those of the pressure propagation from the half portion of the bubble closer to the ejection outlet (V1–V4) have the pressure components in the VA direction which is most effective for the liquid ejection. This portion is important since it is directly contributable to the liquid ejection efficiency, the liquid ejection pressure and the ejection speed. Furthermore, the component V1 is closest to the direction of VA which is the ejection direction, and therefore, is most effective, and the V4 has a relatively small component in the direction VA.

On the other hand, in the case of the present invention, shown in FIG. 23, the movable member 431 is effective to direct, to the downstream (ejection outlet side), the pressure propagation directions V1–V4 of the bubble which otherwise are toward various directions as shown in FIG. 22 and to direct to the pressure propagation direction VA so that the pressure of the bubble 440 is directly and efficiently contributable to the ejection.

Further, the growth direction per se of the bubble is directed downstream similarly to the pressure propagation directions V1–V4, and bubbles grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIGS. 20A to 20D, the ejecting operation of the liquid ejecting head in this embodiment will be described in detail.

FIG. 20A shows a state before the energy such as electric energy is applied to the heat generating element 402, and therefore, no heat has yet been generated. It should be noted that the movable member 431 is so positioned as to be faced at least to the downstream portion of the bubble generated by the heat generation of the heat generating element. In other words, in order that the downstream portion of the bubble acts on the movable member, the liquid flow passage structure is such that the movable member 431 extends at least to the position downstream (downstream of a line passing through the center 403 of the area of the heat generating element and perpendicular to the length of the flow path) of the center 403 of the area of the heat generating element.

FIG. 20B shows a state wherein the heat generation of heat generating element 402 occurs by the application of the electric energy to the heat generating element 402, and a part of of the liquid filled in the bubble generation region 411 is heated by the thus generated heat so that a bubble is generated as a result of film boiling.

At this time, the movable member 431 is displaced from the first position to the second position by the pressure produced by the generation of the bubble 440 so as to guide the propagation of the pressure of the bubble 440 toward the ejection outlet. It should be noted that, as described hereinbefore, the free end 432 of the movable member 431 is disposed in the downstream side (ejection outlet side), and the fulcrum 433 is disposed in the upstream side (common liquid chamber side), so that at least a part of the movable member is faced to the downstream portion of the bubble, that is, the downstream portion of the heat generating element.

FIG. 20C shows a state in which the bubble 440 has further grown. By the pressure resulting from the bubble 440 generation, the movable member 431 is displaced further. The generated bubble grows more downstream than upstream, and it expands greatly beyond a first position (broken line position) of the movable member. Thus, it is understood that in accordance with the growth of the bubble 440, the movable member 431 gradually displaces, by which the pressure propagation direction of the bubble 440, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 20D shows a state wherein the bubble 440 contracts and disappears by the decrease of the pressure in the bubble, peculiar to the film boiling phenomenon.

The movable member 431 having been displaced to the second position returns to the initial position (first position) of FIG. 20A by the restoring force provided by the spring property of the movable member per se and the negative pressure due to the contraction of the bubble. Upon the collapse of bubble, the liquid flows back from the upstream (B), namely the common liquid chamber side as indicated by VD1 and VD2 and from the ejection outlet side as indicated by Vc so as to compensate for the volume reduction of the bubble in the bubble generation region 411 and to compensate for the volume of the ejected liquid.

In the foregoing, the description has been made as to the operation of the movable member with the generation of the bubble and the ejecting operation of the liquid. Now, the description will be made as to the refilling of the liquid in the liquid ejecting head of the present invention.

When the bubble 440 enters the bubble collapsing process after the maximum volume after the state of FIG. 20C, a volume of the liquid enough to compensate for the collapsing bubbling volume flows into the bubble generation region from the ejection outlet 418 side of the first liquid flow path 414 and from the common liquid chamber 413 of the second liquid flow path 416.

In the case of conventional liquid flow passage structure not having the movable member 431, the amount of the liquid from the ejection outlet side to the bubble collapse position and the amount of the liquid from the common liquid chamber, are based on the flow resistance of the portion closer to the ejection outlet than the bubble generation region and the portion closer to the common liquid chamber. (Based on the flow resistance and the inertia of the liquid.) Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this arrangement, because of the provision of the movable member 431, the meniscus retraction stops at the time when the movable member returns to the initial position upon the collapse of bubble, and thereafter, the supply of the liquid to fill a volume W2 is accomplished by the flow VD2 through the second flow path 416 (W1 is a volume of an upper side of the bubble volume W beyond the first position of the movable member 431, and W2 is a volume of a bubble generation region 11 side thereof). In the prior art, a half of the volume of the bubble volume W is the volume of the meniscus retraction, but according to this arrangement, only about one half (W1) is the volume of the meniscus retraction.

Additionally, the liquid supply for the volume W2 is forced to be effected mainly from the upstream (VD2) of the second liquid flow path along the surface of the heat generating element side of the movable member 431 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. However, according to this embodiment, the flows of the liquid in the first liquid flow path 414 at the ejection outlet side and the ejection outlet side of the bubble generation region 411 are suppressed, so that the vibration of the meniscus is extremely reduced.

Thus, according to this arrangement applicable to the present application, the high speed refilling is accomplished by the forced refilling to the bubble generation region through the liquid supply passage 412 of the second flow path 416 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The arrangement provides the following effective function. It is a suppression of the propagation of the pressure to the upstream side (back wave) produced by the generation of the bubble. The pressure due to the common liquid chamber 413 side (upstream) of the bubble generated on the heat generating element 402 mostly has resulted in force which pushes the liquid back to the upstream side (back wave). The back wave deteriorates the refilling of the liquid into the liquid flow path by the pressure at the upstream side, the resulting motion of the liquid and the inertia force. In this arrangement, these actions to the upstream side are suppressed by the movable member 431, so that the refilling performance is further improved.

The description will be made as to a further characterizing feature and the advantageous effect.

The second liquid flow path 416 of this arrangement has a liquid supply passage 412 having an internal wall substantially flush with the heat generating element 402 (the surface of the heat generating element is not greatly stepped down) at the upstream side of the heat generating element 402. With this structure, the supply of the liquid to the surface of the heat generating element 402 and the bubble generation region 411 occurs along the surface of the movable member 431 at the position closer to the bubble generation region 411 as indicated by VD2. Accordingly, stagnation of the liquid on the surface of the heat generating element 402 is suppressed, so that precipitation of the gas dissolved in the liquid is suppressed, and the residual bubbles not extincted are removed without difficulty, and in addition, the heat accumulation in the liquid is not too much. Therefore, the stabilized bubble generation can be repeated at a high speed. In this arrangement, the liquid supply passage 412 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 435) as indicated by VD1. In order to direct the pressure upon the bubble generation further effectively to the ejection outlet, a large movable member covering the entirety of the bubble generation region (covering the surface of the heat generating element) may be used, as shown in FIGS. 20A to 20D. Then, the flow resistance for the liquid between the bubble generation region 411 and the region of the first liquid flow path 414 close to the ejection outlet is increased by the restoration of the movable member 431 to the first position, so that the flow of the liquid to the bubble generation region 411 from VD1 can be prevented. However, according to the head structure of this arrangement, there is a flow effective to supply the liquid to the bubble generation region, the supply performance of the liquid is greatly increased, and therefore, even if the movable member 431 covers the bubble generation region 411 to improve the ejection efficiency, the supply performance of the liquid is not deteriorated.

The positional relation between the free end 432 and the fulcrum 433 of the movable member 431 is such that the free end is at a downstream position of the fulcrum as indicated in FIG. 23, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 410 upon the supply of the liquid thus permitting the high speed refilling. When the meniscus M retracted by the ejection as shown in FIG. 23, returns to the ejection outlet 418 by capillary force or when the liquid supply is effected to compensate for the collapse of bubble, the positions of the free end and the fulcrum 433 are such that the flows S1, S2 and S3 through the liquid flow path 410 including the first liquid flow path 414 and the second liquid flow path 416, are not impeded.

More particularly, in this arrangement, as described hereinbefore, the free end 432 of the movable member 431 is faced to a downstream position of the center 403 of the area which divides the heat generating element 402 into an upstream region and a downstream region (the line passing through the center (central portion) of the area of the heat generating element and perpendicular to a direction of the length of the liquid flow path). The movable member 431 receives the pressure and the bubble which are greatly contributable to the ejection of the liquid at the downstream side of the area center position 403 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 431, contributes to the ejection of the liquid.

The embodiments of the present invention will be explained in detail with reference to the accompanying drawings.

Figure 1:
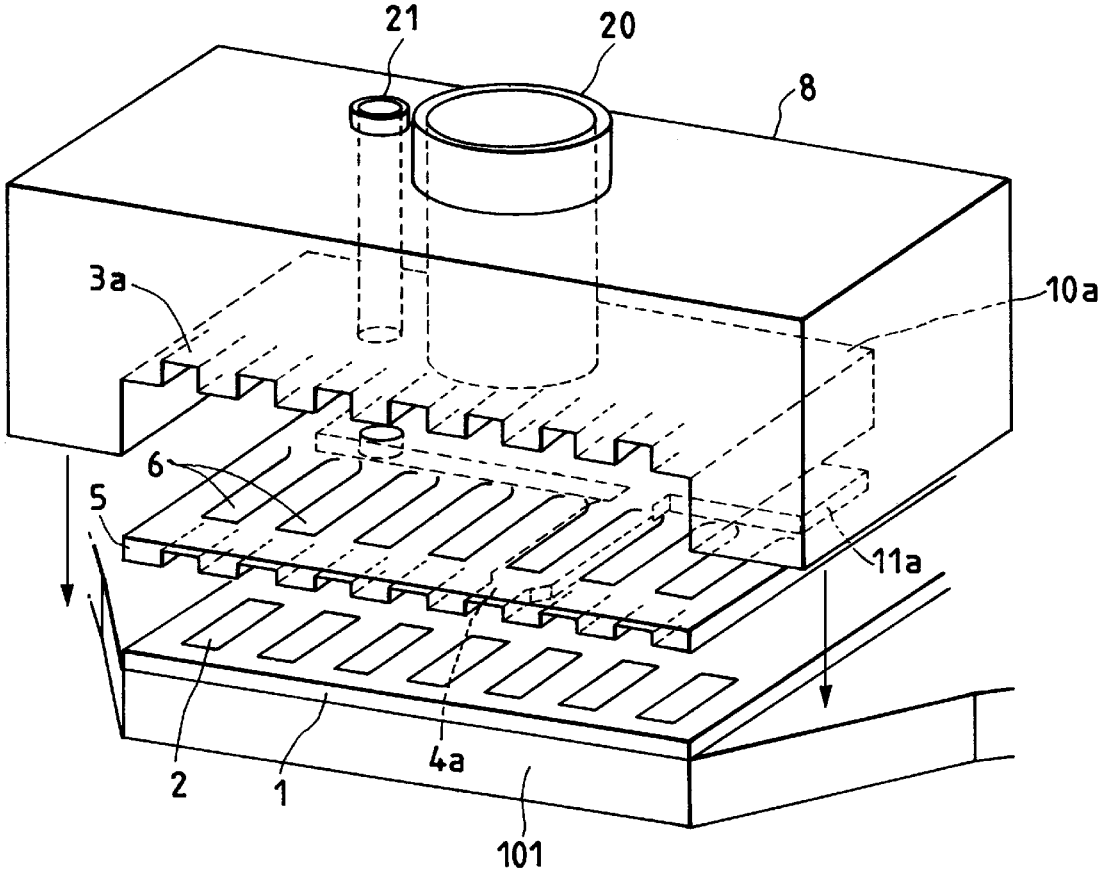
FIG. 1 is a schematic, exploded view for explaining the structure of a major part in an embodiment of the liquid ejecting head according to the present invention.
Figure 2:
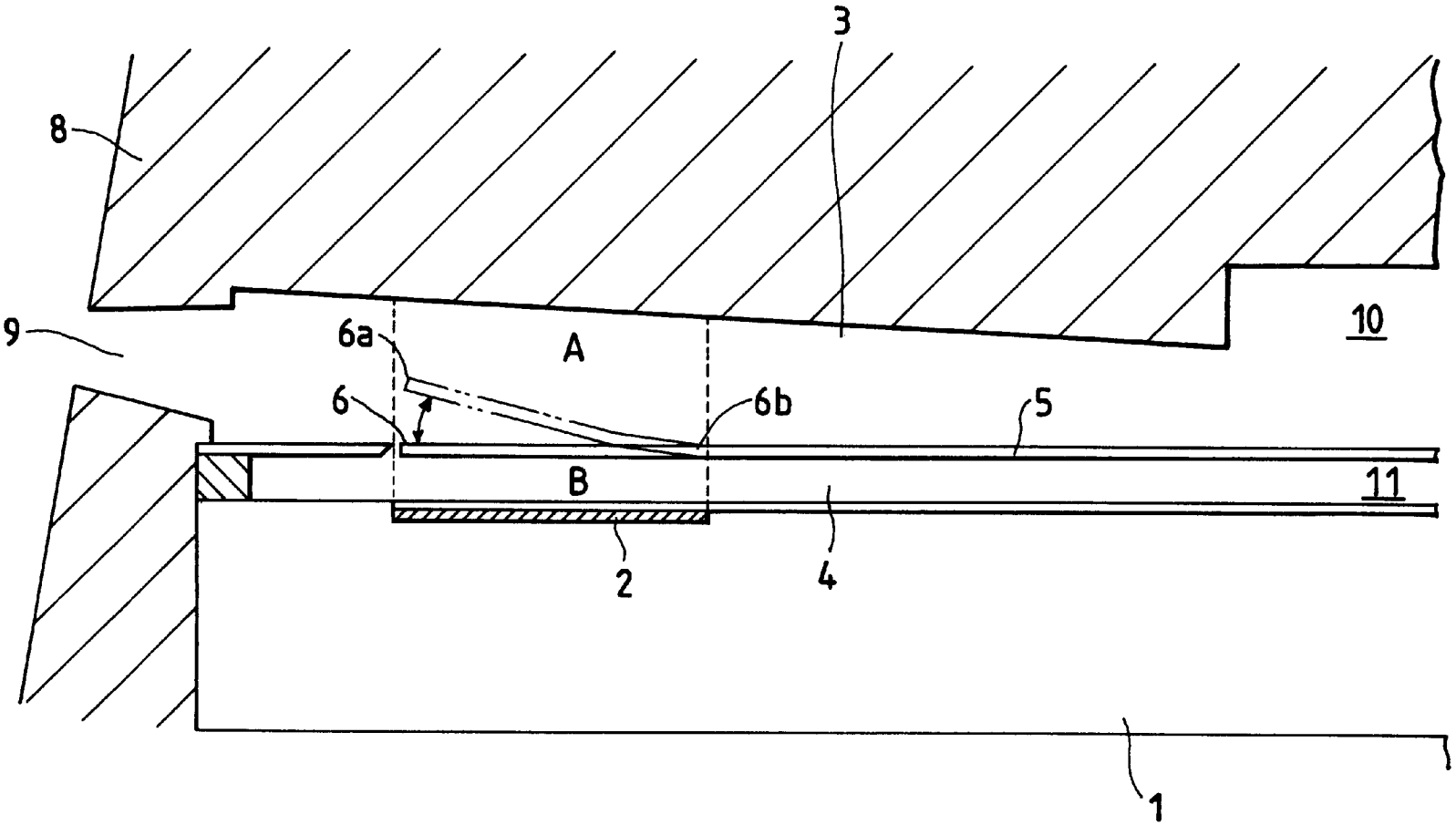
FIG. 2 is a sectional view to show a portion of an ejection outlet and liquid flow paths as a major part of the liquid ejecting head shown in FIG. 1.

FIG. 1 is a schematic, exploded, perspective view for explaining the major structure in an embodiment of the liquid ejecting head according to the present invention. FIG. 1 is illustrated as omitting an orifice plate provided with ejection outlets. FIG. 2 is a sectional view to show a portion of an ejection outlet and liquid flow paths as a major part of the liquid ejecting head of FIG. 1, and FIG. 3 is a partial, schematic drawing to show a major part of the liquid ejecting head of FIG. 1.

Figure 3:
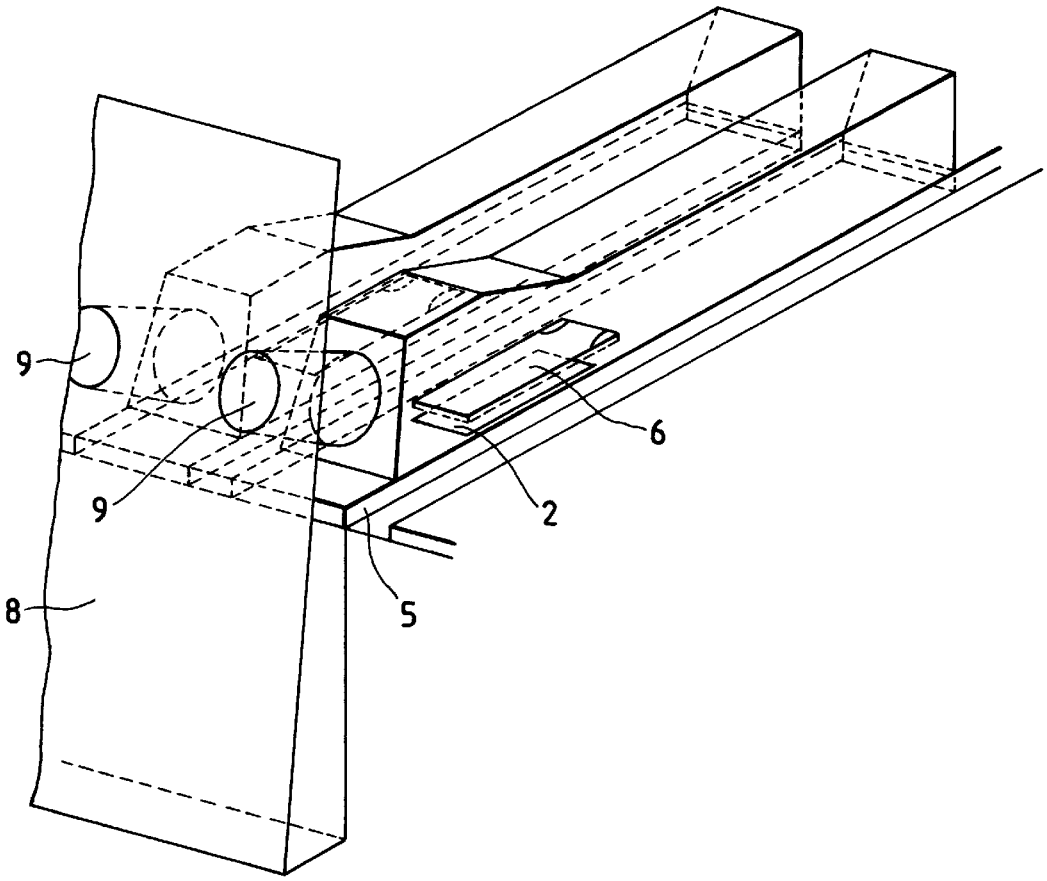
FIG. 3 is an exploded diagram to show a major part of the liquid ejection head shown in FIG. 1.

In FIGS. 1 to 3, reference numeral 1 designates an element substrate in which heat generating elements 2 are provided as elements for electrothermal transduction for supplying the thermal energy for generating a bubble to the liquid.

The element substrate 1 has patterned wiring electrode (0.2 to 1.0 $\mu$m thick) of aluminum (Al) or the like and patterned electric resistance layer (0.01 to 0.2 $\mu$m thick) of hafnium boride ($HfB_2$), tantalum nitride (TaN), tantalum aluminum (TaAl) or the like constituting the heat generating elements 2 on a silicon oxide ($SiO_2$) film or silicon nitride (SiN) film for electric insulation and thermal accumulation formed on the substrate of silicon or the like. The heat generating element 2 generates heat when a voltage is applied to the resistance layer through the wiring electrodes.

A protection layer of $SiO_2$, SiN, or the like (0.1 to 2.0 $\mu$m thick) is provided on the resistance layer (heat generating element 2) between the wiring electrodes, and in addition, an anti-cavitation layer of tantalum (Ta) or the like (0.1 to 0.6 $\mu$m thick) is formed thereon to protect the heat generating element 2 from various liquids such as ink.

The pressure and shock wave generated upon bubble generation and collapse is so strong that the durability of the protection film hard and relatively fragile is considerably deteriorated. Therefore, a metal material such as Ta or the like is preferably used as a material for the anti-cavitation layer.

The protection layer on the heat generating element 2 may be omitted depending upon the combination of liquid, liquid flow path structure, and resistance material. The material for the resistance layer not requiring the protection layer on the heat generating element 2, includes, for example, iridium-tantalum-aluminum (Ir-Ta-Al) alloy or the like.

Thus, the structure of the heat generating element in the foregoing embodiments may include only the resistance layer (heat generating portion) between the electrodes as described, or may include a protection layer for protecting the resistance layer.

In this embodiment, the heat generating element has a heat generation portion having the resistance layer which generates heat in response to the electric signal. Without having to be limited to this, any means well suffices if it creates a bubble enough to eject the liquid in the first path portion, in the liquid in the second path portion. For example, the heat generation portion may be in the form of a photothermal transducer which generates heat upon receiving light such as laser, or a heat generating element having the heat generation portion which generates heat upon receiving high frequency wave.

Function elements such as a transistor, a diode, a latch, a shift register, and so on for selectively driving the electrothermal transducer may also be integrally built in the element substrate 1, in addition to the electrothermal transducer (heat generating element) comprised of the resistance layer and the wiring electrodes for supplying the electric signal to the resistance layer, as described above.

On the element substrate 1 provided with the heat generating element 2 there is the second path portion 4 of a liquid flow path in the bottom surface of which the heat generating element 2 is formed in order to let the thermal energy generated by the heat generating element 2 act on the liquid. Further, above the second path portion 4 there is provided the first path portion 3 of a liquid flow path in direct fluid communication with the ejection outlet 9. The partition wall 5 formed of a material having elasticity, such as a metal, a resin, or the like, is disposed between the second path portion 4 and the first path portion 3, thereby separating the second path portion from the first path portion.

A projection space in the direction perpendicular to the surface where the heat generating element 2 is formed (above the heat generating element 2) in the liquid flow paths (region A in the first path portion and region B in the second path portion in FIG. 1) is an ejection pressure generating region where the pressure for ejecting the liquid acts. The liquid jet head of the present invention generates a bubble when the liquid in the second path portion is heated by the heat generating element, and the pressure raised with growth of bubble upon generation of the bubble acts in the ejection pressure generating region to eject the liquid.

A movable member 6 is formed in a cantilever beam shape by slit in the portion of the partition wall 5 located in this ejection pressure generating region. This movable member 6 is formed in such an arrangement that a free end 6*a* thereof is located on the side of the ejection outlet 9 (on the downstream side in the fluid flow direction or on the left side as facing FIG. 2) and a fulcrum 6*b* of the movable member 6 is located on the side of a common liquid chamber 10 to the first path portions 3 and a common liquid chamber 11 to the second path portions 4.

Since the liquid ejecting head of the present invention has the movable member 6 in the partition wall 6 as facing the ejection pressure generating region B in the second path portion, the movable member 6 operates to open to the side of the first path portion 3 (or in the direction of the arrow in FIG. 2) by the pressure caused by bubble generation of the liquid in the second path portion, as described below.

The material for forming the partition wall 5 having the movable member 6 may be any material having solvent resistance against the liquid in the liquid flow paths, having elasticity enough to operate well as the movable member, and permitting formation of fine slit. Preferable examples of materials meeting these requirements include resin materials having high heat resistance, high solvent resistance, and high moldability, more particularly recent engineering plastic resin materials such as polyethylene, polypropylene, polyamide, polyethylene terephthalate, melamine resin, phenolic resin, epoxy resin, polybutadiene, polyurethane, polyetheretherketone, polyether sulfone, polyallylate, polyimide, polysulfone, liquid crystal polymer (LCP), and so on, chemical compounds thereof, or metals such as silicon dioxide, silicon nitride, nickel, gold, stainless steel, and so on, alloys and chemical compounds thereof, or materials coated with titanium or gold.

The thickness of the partition wall 5 is determined depending upon the material and configuration used from the standpoints that the strength necessary for the partition wall 5 can be achieved and that the movable member 6 can operate well, and generally is in the range of 0.5 $\mu$m to 10 $\mu$m, desirably.

Figures 24A, 24B, 24C:
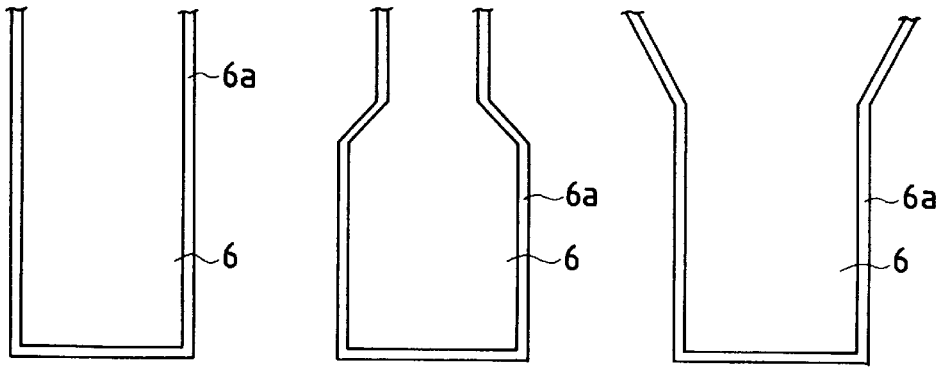
FIGS. 24A to 24C are schematic plan views to show a configuration of a slit in the partition wall.

The configuration of the slit may be either rectangular as shown in FIG. 24A, tapered toward the fulcrum as shown in FIG. 24B, or widened toward the fulcrum as shown in FIG. 24C. The configuration of FIG. 24B facilitates the operation of the movable member while the configuration of FIG. 24C improves the durability of the movable member. Without having to be limited to the above configurations of the slit, the slit in the present invention may be any that can be positioned in the second path portion.

If the bubble generation liquid is different from the ejection liquid and if mixture of the two liquids is desired to be prevented, the width of the slit between the partition wall 5 and the movable member 6 is determined to be a gap to form a meniscus between the two liquids, thereby controlling fluid communication between the two liquids. For example, supposing the bubble generation liquid is a liquid having the viscosity of about 2 cP (centipoise) and the ejection liquid is a liquid having the viscosity of 100 or more cP, the slit of about 5 $\mu$m is enough to avoid mixture of the liquids, but a desirable width is not more than 3 $\mu$m.

The configuration of the second path portion 4 may be any configuration that can effectively transmit the pressure caused with generation of bubble to the movable member side. However, if the chamber (bubble generation chamber) structure is such that the second path portion 4 has a throat portion on the upstream side of the heat generating element 2 (where the "upstream side" means an upstream side in a large flow from the liquid chamber side through the heat generating element position, the movable member, and the first path portion 3 to the ejection outlet) so as to stop the pressure upon bubble generation from readily escaping to the upstream side of the second path portion, the pressure upon bubble generation in the second path portion 4 can be further prevented from escaping to the surroundings, and the pressure can be directed as concentrated to the movable member side, thereby achieving higher ejection efficiency and ejection force.

When the height of the second path portion 4 is determined at such a value that a part of the bubble generated in the second path portion 4 extends into the first path portion, the ejection force can be improved more than in the cases where the bubble does not extend into the first path portion 3. For the bubble to extend into the first path portion 3 in this manner, the height of the second path portion 4 is desirably determined to be lower than the height of the maximum bubble, and, specifically, the height is desirably determined in the range of several $\mu$m to 30 $\mu$m.

The first path portions 3 in communication with the ejection outlets 9 are provided above the partition wall 5, and the first path portions 3 are formed by joining the partition wall 5 to the grooved top plate 8 in which first recesses 3*a* to become the first path portions are formed. This grooved top plate 8 is further provided with an orifice plate having the ejection outlets 9, and a recess 10*a* to be a liquid chamber for supplying the liquid to the liquid flow paths.

Since this liquid ejecting head is arranged so that the second path portion being a portion for generating the bubble is separated from the first path portion in fluid communication with the ejection outlet by the partition wall, the liquid in the second path portion may be different from the liquid in the first path portion. The present embodiment shows the liquid ejecting head of the two-path structure which permits different liquids to be used between in the second path portion and in the first path portion.

The top plate 8 has a first supply port 20 for supply of the liquid into the first common liquid chamber and a second supply port 21 for supplying the liquid into the second common liquid chamber. The second supply port is connected to a communication path disposed outside the first common liquid chamber, piercing the partition wall, and communicating with the second common liquid chamber, and thanks to this communication path the liquid to be supplied to the second path portion can be supplied to the second common liquid chamber without being mixed with the liquid to be supplied to the first path portion.

The sizes, configurations, and locations of the heat generating elements 2 and movable members 6 are not limited to those described above, but they may be determined so as to effectively utilize the pressure upon generation of bubble as ejection energy.

In the present invention, the partition wall 5 and the side walls of the second path portions 4 are formed in an integral fashion. The term "integral" herein means that the partition wall 5 and the side walls of the second path portions 4 compose a single member when the partition wall 5 is joined to the element substrate 1, and, therefore, the material for the partition wall and the material for the side walls of the second path portions may be the same or different from each other. Since in the present invention the partition wall 5 and the side walls of the second path portions 4 are formed in an integral fashion, no gap possibly occurs between the partition wall 5 and the side walls of the second path portions 4, thereby improving the yield of the liquid ejecting head. When the partition wall 5 and the side walls of the second path portions 4 are formed in an integral fashion, fitting grooves for fitting of walls of the first path portions may be formed in portions of the partition wall 5 in contact with the side walls of the first path portions. The formation of the fitting grooves in the partition wall 5 enables the grooved top plate 8 having the side walls of the first path portions to be easily positioned relative to the partition wall 5, and also presents the effect that positional deviation can be reduced between the first path portions 3 and the movable members 6 when the grooved top plate 8 is thermally expanded.

In the description of the present invention the name "grooved partition wall" is used for a member in which the partition wall 5 and the side walls of the second path portions 4 are integrally formed, thereby discriminating it from the ordinary partition wall.

Next explained is an example of a method for assembling the major part of the liquid ejecting head according to the present invention.

Figure 4:
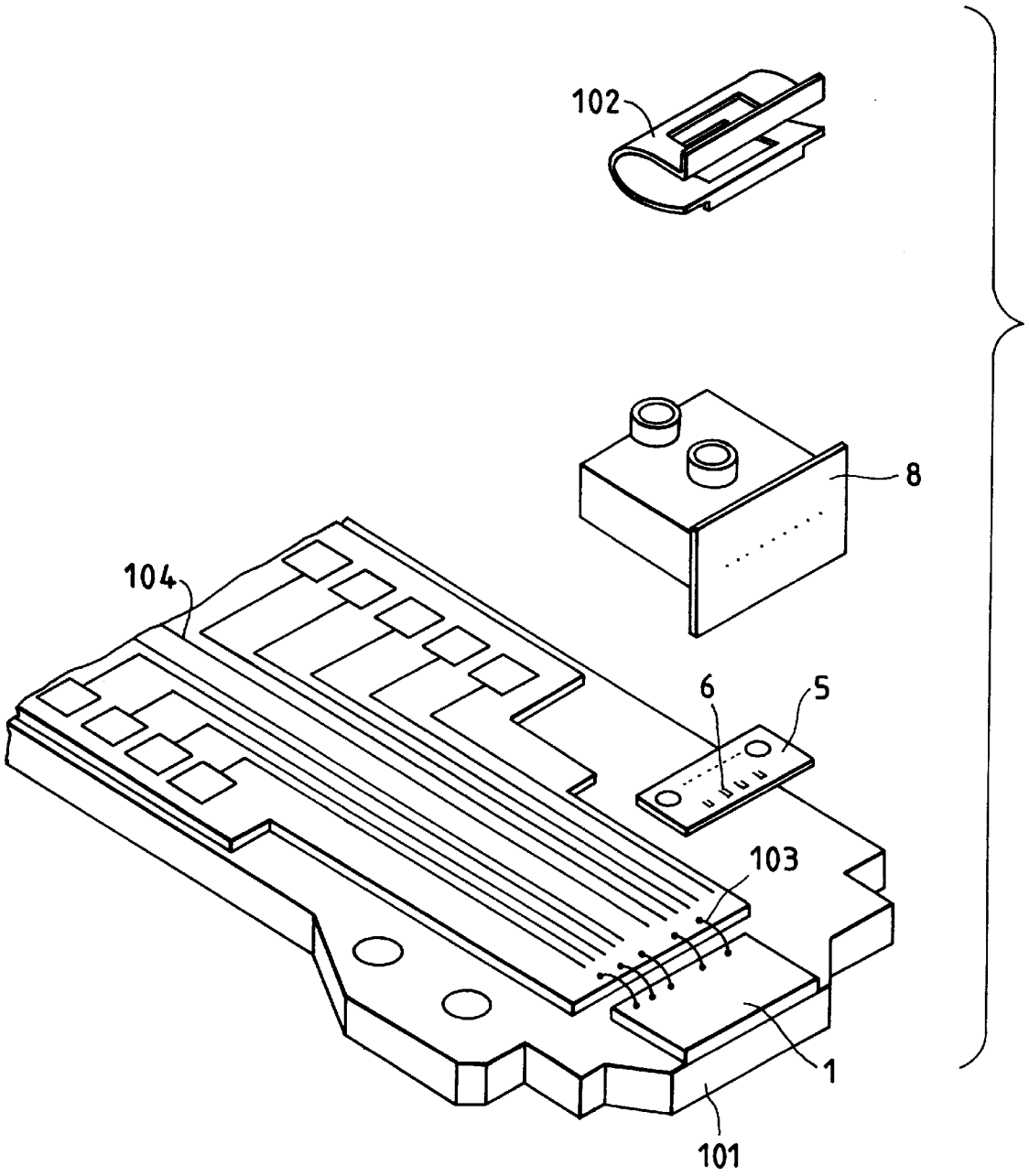
FIG. 4 is an exploded, perspective view to show a major part of the liquid jet head according to the present invention.

FIG. 4 is an exploded, perspective view to show the major part of the liquid ejecting head of the present invention. In this example, the top plate 8 is first fixed upside down and the grooved partition wall 5 having the movable members 6 is set on the top plate 8, using a vacuum pump. After positioning the partition wall by micro fine adjustment, the grooved partition wall 5 is fit in the top plate 8.

Next, using a splicing machine, positions of the electrothermal transducers on the substrate 1 are measured on an image obtained by a TV camera or the like and a position of the top plate 8 to be bonded at a predetermined position is also measured on the image as being moved, whereby positioning is achieved between the electrothermal transducers formed in the substrate 1 and the ejection outlets 9. Then the top plate 8 and substrate 1 are pressed to fit with each other by a stop spring 102.

Another splicing method between the top plate 8 and the substrate 1 is exciting top connection. The "exciting top connection" is carried out as follows. The top plate 8 is first roughly positioned on the substrate 1 provided with an engaging groove into which a flow path wall of the top plate 8 is fitted and the top plate 8 is lightly and normally pressed from the top. In this state, a signal is supplied to a piezoelectric device in contact with a front bottom surface of a base plate 101 so that the flow path wall is fitted into the engaging groove to position the top plate and the substrate 1. The piezoelectric device for giving vibration (rectangular wave of about 5 kHz in this example) to the substrate 1 vibrates in the amplitude of approximately 1 $\mu$m. The time is about 1 second. After stop of vibration, they are secured to each other by the stop spring 102 or by an adhesive or the like.

Further, the first liquid chamber 10 and the second liquid chamber 11 are sealed with a sealant as surrounding them, thereby maintaining airtightness.

Next explained in detail is a method for producing the partition wall in particular in the liquid ejecting head of the present invention.

Figure 5:
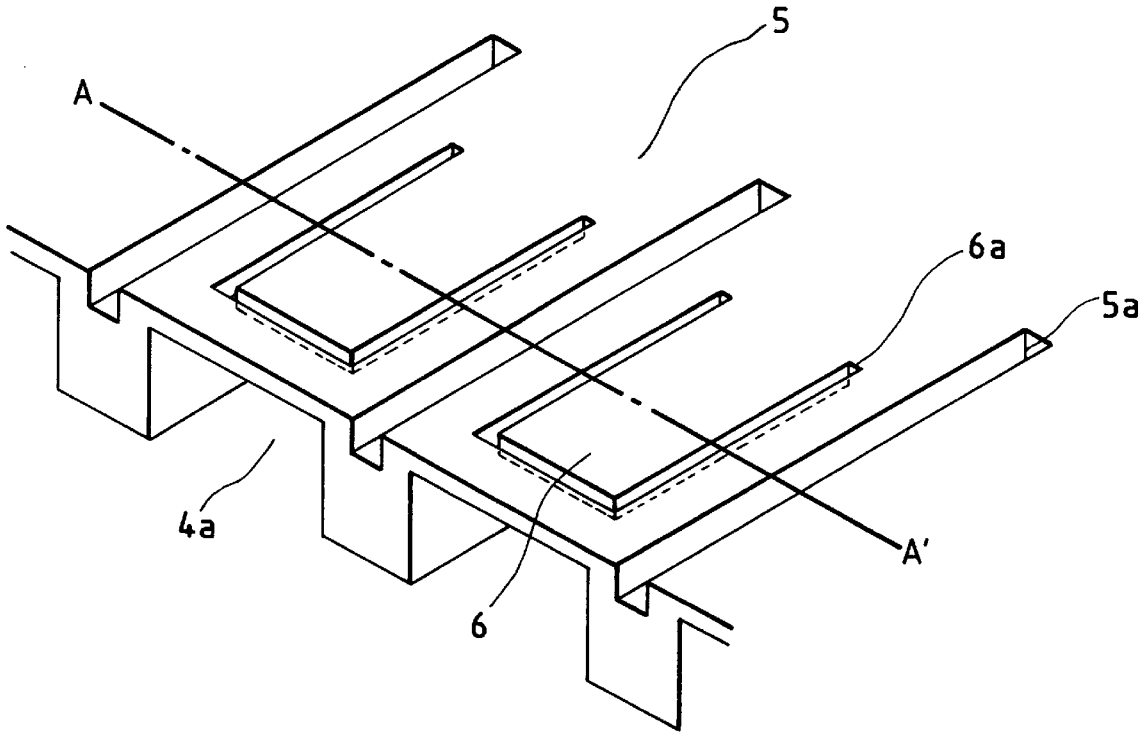
FIG. 5 is a diagrammatic, perspective view to show a grooved partition wall in which a partition wall and side walls of second path portions are integrally formed.

FIG. 5 is a schematic, perspective view to show the grooved partition wall integrally incorporating the partition wall and the side walls of the second path portions according to the present invention.

In FIG. 5, numeral 5 denotes the grooved partition wall, and a movable member 6 is formed by a slit 6*a* in the grooved partition wall 5. Further, the side walls of the second path portions are also provided in the grooved partition wall 5 and the side walls of the second path portions form second recesses 4*a* to be the second path portions.

Since this grooved partition wall 5 has the integral arrangement of the partition wall and the side walls of the second path portions, no gap will possibly occur between the partition wall portion and the side wall portions of the second path portions, which reduces losses of ejection pressure and propagation of the pressure into adjacent liquid flow paths, thereby enabling to provide the liquid ejecting head excellent in ejection characteristics. When this structure is employed, the productivity of the liquid ejecting head can be improved more than heretofore.

Further, it was difficult to form the fitting grooves 5*a* for positioning of the walls of first path portions in the partition wall because of insufficient strength of the partition wall when the partition wall was separately formed from the second path portions. However, the integral structure of the partition wall and the second path portions enables the fitting grooves 5*a* to be formed in the grooved partition wall 5.

The grooved partition wall 5 of the present invention permits the partition wall portion and the side wall portions of the second path portions to be made of a same material or of different materials. The slits 6*a* in the partition wall portion can be formed by electroforming or laser irradiation. Especially, when the partition wall is formed by electroforming, the slits 6*a* can be formed at high accuracy even when the slits of partition wall are considerably thin. Further, since the slits 6*a* are also formed at the same time as production of the partition wall, the process can be simplified. Since the thickness of the partition wall can be controlled evenly when the partition wall is produced by electroforming, performance of each movable member can be uniform even when the partition wall has a plurality of movable members.

When the slits are made by laser irradiation, a resin as well as a metal can be used as a material for forming the partition wall.

The side wall portions of the second path portion in the grooved partition wall can be made by electroforming or etching. For simplifying the process, the partition wall can be made by electroforming of a matrix having a mold of the second recess.

Figure 25A:
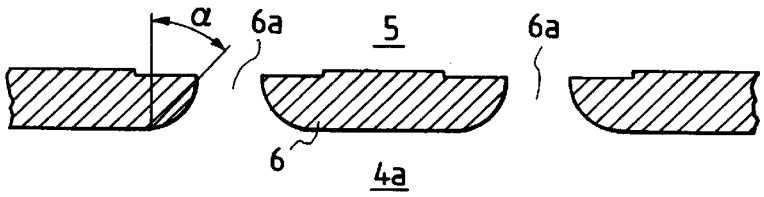
FIG. 25A is an enlarged sectional view of the slits produced by the electroforming and FIG. 25B is an enlarged sectional view of the slits formed by the laser irradiation.
Figure 25B:
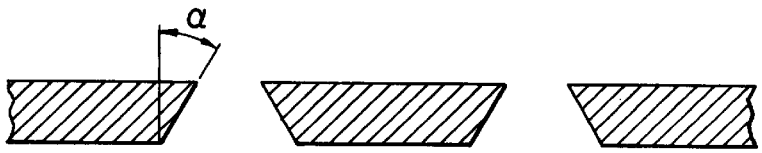
Figure 25C:
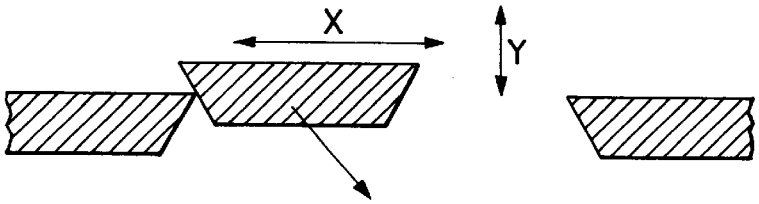
FIGS. 25C and 25D show movement of an operation region of a movable member.
Figure 25D:
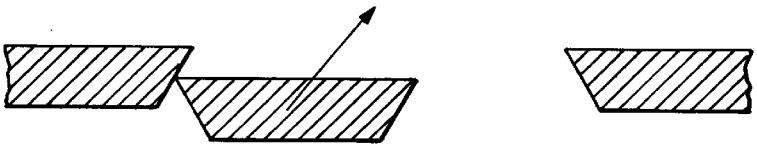

Ends of the slits made by electroforming or laser irradiation has an R-tapered shape or a straight tapered shape as shown in the FIGS. 25A and 25B. FIG. 25A is an enlarged sectional view of the slits produced by the electroforming and 25B is an enlarged sectional view of the slits formed by the laser irradiation. The tapered shapes of FIGS. 25A and 25B have the following advantages. When the movable member is displaced for a long time, an operation region of the movable member may be deviated due to mechanical fatigue (reduction of rigidity) in an X-direction or a Y-direction as shown in FIG. 25C. If the operation region of the movable member is deviated, the durability of the movable member may be reduced. However, the ends of the slits are tapered, the tapered shape of the movable member functions to correct the deviation when the movable member operates as shown in FIGS. 25C and 25D even if the operation region of the movable member is deviated so that the durability of the movable member can be improved. A taper angle a of the slit ends varies in accordance with manufacturing conditions. However, it is found that the above advantage can be obtained if the taper angle is 2°–45° in a direction of the thickness of the movable member. Preferably, the taper angle of the slit ends is within a range of 5°–15°.

Specific methods for producing the grooved partition wall will be explained using the following examples.

The partition wall obtained in each example to follow is a member that can be suitably incorporated in the liquid ejecting head of the present invention.

The explanatory drawings for explaining Examples 1 to 7 all are cross sections along the A—A' plane in FIG. 5.

(Example 1)

FIGS. 6A to 6H are schematic, sectional views to show steps for producing the partition wall, as an example of the method for integrally producing the side walls of the second path portions and the movable members in the partition wall by two-stage electroforming.

Figure 6A:
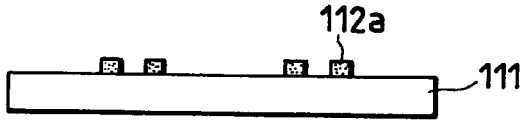
FIGS. 6A to 6H are explanatory drawings to show steps for producing the partition wall in Embodiment 1 of the present invention.

As shown in FIG. 6A, the SUS substrate 111 (SUS-316 in this example) as a stainless steel substrate was first coated with a resist 112*a* 4 μm thick, and this resist was patterned in the shape corresponding to the slit portion of the movable member. The resist 112*a* used was PMER P-AR900 (trade name, available from Tokyo Ouka Sha). Exposure was carried out using MPA-600 available from Canon Kabushiki Kaisha, and exposure dose was 500 mJ/cm$^2$. Development was made using a developer, P-6G (trade name, available from Tokyo Ouka Sha).

Figure 6B:
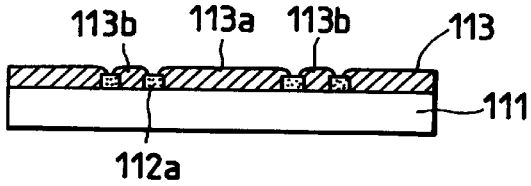

Then, as shown in FIG. 6B, electroplating was conducted to grow nickel in 5 μm as a first plating layer 113 on the substrate 111. The plating solution used was the one containing nickel sulfamate, a stress decrease material ZERO ALL (registered trade name, available from WORLD METAL INC.), boric acid, a pit prevention material NS-APS (trade name, available from WORLD METAL INC.), and nickel chloride. The electrolysis upon electroplating was established under such conditions that the electrode was connected to the anode, the SUS substrate 111 already patterned was connected to the cathode, the temperature of the plating solution was controlled at 50° C., and the current density was 5 A/dm$^2$. The first plating layer 113 formed on the substrate 111 by electroplating as described comprises a plate member 113*a* to constitute the partition wall, and movable members 113*b* in a cantilever beam shape separated from the plate member 113*a* by the predetermined slit.

Figure 6C:
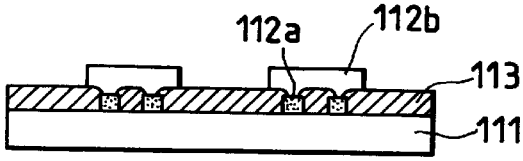

Next, as shown in FIG. 6C, the SUS substrate 111 was immersed in a palladium catalyst solution, and thereafter a resist 112*b* was formed in the thickness of 10 μm on the SUS substrate 111. This resist was patterned in the shape corresponding to the recesses for the second path portions. The resist 112*b* used was PMER P-AR900 (trade name, available from Tokyo Ouka Sha). Exposure was made using MPA-600 available from Canon Kabushiki Kaisha, and the exposure dose was 1200 mJ/cm$^2$. Development was carried out in the same manner as in the step shown in FIG. 6A. The resist 112*b* was formed in elongate band portions including the movable members 113*b* of the first plating layer 113. The band portions are portions to become the second path portions 2 as second recesses.

Figure 6D:
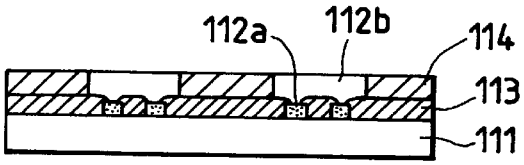

After that, as shown in FIG. 6D, Ni-B based electroless plating was carried out to form a film approximately 3 μm thick in exposed portions of the first plating layer 113, and thereafter a plating layer was grown in 7 μm by the same method as the electroplating described with FIG. 6B to form a second plating layer 114. This plating step may be carried out only by the Ni-B based electroless plating to form the second plating layer 114 10 μm thick. The second plating layer 114, formed on the first plating layer 113 by the plating step discussed, is integrally joined in sufficient strength with the first plating layer 113.

Figure 6E:
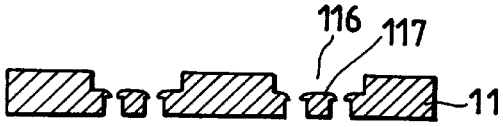

After completion of the above plating, as shown in FIG. 6E, the resists 112*a*, 112*b* were then removed and the nickel plates of the first plating layer 113 and second plating layer 114 were stripped off from the SUS substrate 111 by means of ultrasonic vibration or the like to form the second recesses 116 to become the second path portions and the movable members 117 in the partition wall, thereby obtaining a nickel plate 115 that can be used as a partition wall.

Grooves for positioning the walls of the first path portions, if desired to be formed in the partition wall, can be further produced according to the following steps.

Figure 6F:
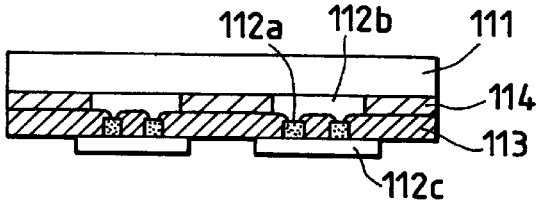

After the step of FIG. 6E, as shown in FIG. 6F, the substrate 111 stripped off at the step of FIG. 6E was joined to the side of the second plating layer 114 of the nickel plate, and the stripped-side surface of the nickel plate was coated with a resist 2 μm thick. Then the resist was patterned to remove portions thereof to become the grooves for positioning the walls of the first path portions.

Figure 6G:
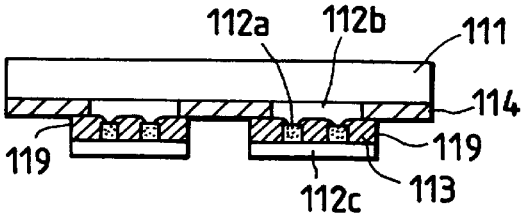

Then, as shown in FIG. 6G, the nickel plate was etched to form fitting grooves 119. The etchant used may be ferric chloride, a mixture solution of nitric acid, acetic acid, and acetone, or the like.

Figure 6H:
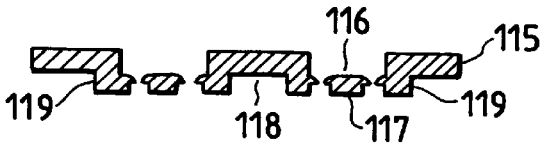

After that, as shown in FIG. 6H, the resist 112*c* was removed to form the second recesses 116 to become the second path portions, the movable members 117 in the partition wall, and the grooves 119 for positioning the walls of the first path portions, thus obtaining the nickel plate 115 that can be used as a partition wall. Here, reference numeral 118 in FIG. 6H designates a recess for receiving a wall of a first path portion in the top plate separately produced.

Since in this example the slit is formed by electroforming between the partition wall 115 and the movable member 117, the slit width can be precisely controlled within a predetermined range and the thickness of the partition wall 115 can also be uniformly controlled.

(Example 2)

FIGS. 7A to 7D are schematic, sectional views to show steps for producing the partition wall as an example for uniformly producing the side walls of second path portions, the movable members, and the grooves for positioning the walls of first path portions by electroforming using a matrix.

Figure 7A:
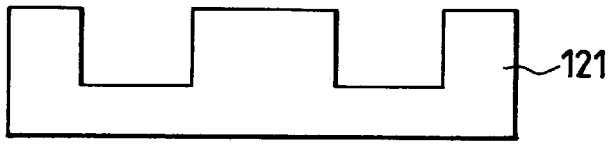
FIGS. 7A to 7D are explanatory drawings to show steps for producing the partition wall in Embodiment 2 of the present invention.

Preliminarily prepared was a matrix 121 having the second recesses to become the second path portions as shown in FIG. 7A.

This matrix can be produced for example according to the following steps.

Figure 8A:
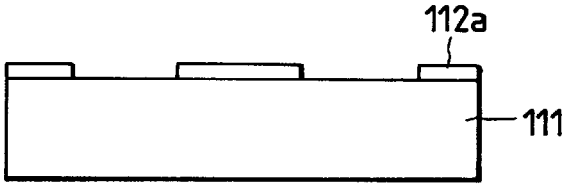
FIGS. 8A to 8C are explanatory drawings to show steps for producing a matrix used in Embodiment 2 of the present invention.
Figure 8B:
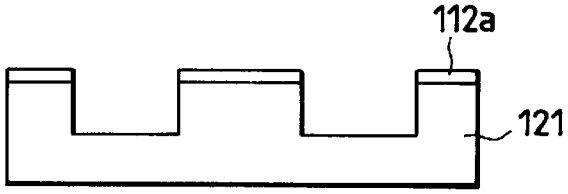
Figure 8C:
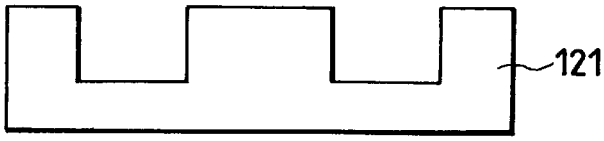

As shown in FIG. 8A, a resist 112*a* approximately 2 μm thick was formed on the SUS substrate 111 and the resist 112*a* was patterned by photolithography to remove portions to become the second path portions from an integral member for partition wall. Then, as shown in FIG. 8B, exposed portions of the substrate 111 were etched using a mixture solution of alcohol, hydrochloric acid, and hydrogen peroxide to form the second recesses to become the second path portions in the depth of approximately 10 μm. After that, as shown in FIG. 8C, the resist 112*a* was removed to obtain a matrix 121 comprised of the substrate 111 having the second recesses.

Figure 7B:
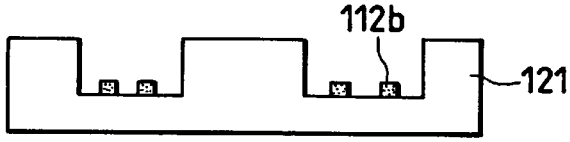

Preparing the matrix 121, as shown in FIG. 7B, a coating of resist 112*b* 7 μm thick was then formed in the bottom portions in the second recess portions in the matrix 121, and this resist was patterned to form portions corresponding to the slit portions for the movable members.

Figure 7C:
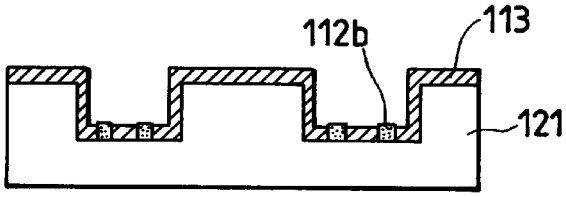

Then, as shown in FIG. 7C, electroplating was carried out in the same manner as in Example 1 to form a nickel plating layer 113 approximately 5 μm thick over the top surface of matrix 121 and the inner surfaces of the second recesses.

Figure 7D:
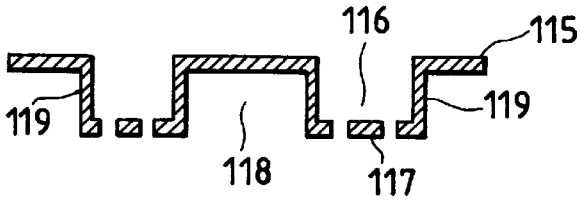

Then, as shown in FIG. 7D, the resist 112*b* was removed and the nickel plate comprised of the plating layer 113 was stripped off from the matrix 121 to form the second recesses 116 to become the second path portions, the movable members 117 in the partition wall, and the grooves 119 for positioning the walls of the first path portions, thereby obtaining the nickel plate 115 that can be used as a partition wall.

Since in this example the partition wall can be formed by single electroplating by using the matrix 121, the step for forming the second recesses can be eliminated, thus decreasing the number of steps.

Since also in this example the slits for the movable members 117 are produced by electroforming similarly as in Example 1, the slit width can be precisely controlled in the predetermined range and the thickness of the partition wall 15 can be uniformly controlled.

(Example 3)

FIGS. 9A to 9F are schematic, sectional views to show steps for producing the partition wall as an example for integrally forming the side walls of second path portions and the movable members in the partition wall by performing two-stage electroforming with different materials and forming the second recesses by etching.

Figure 9A:
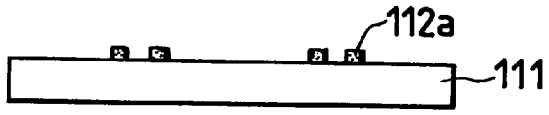
FIGS. 9A to 9F are explanatory drawings to show steps for producing the partition wall in Embodiment 3 of the present invention.

First, as shown in FIG. 9A, the resist 112*a* was formed in the thickness of 5 μm on the SUS substrate 111, similarly as in Example 1, and this resist was patterned to form portions corresponding to the slit portions for the movable members. The width of the resist 112*a* for forming the slit portions may be arbitrarily determined within the range of 0.5 to 1 μm.

Figure 9B:
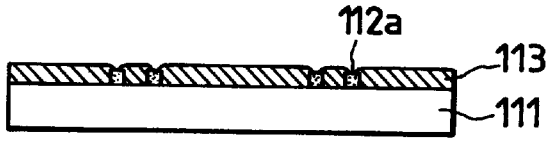

Then, as shown in FIG. 9B, electroplating was conducted to grow gold 5 μm thick as a first plating layer 113 in exposed portions of substrate 111. The plating solution used was potassium gold cyanide and potassium cyanide. Electrolysis upon electrodeposition was effected under such conditions that the electrode was connected to the anode, the SUS substrate 111 already patterned was connected to the cathode, the temperature of the plating solution was controlled at 65° C., and the current density was 3 A/dm$^2$.

Figure 9C:
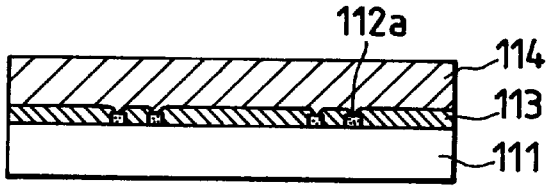

Next, as shown in FIG. 9C, electroplating was carried out under the same conditions with the same plating solution as in Example 1, on the surface of the substrate 111 with the gold layer electrolytically formed thereon as a first plating layer 113, so as to grow a nickel layer 10 μm thick as a second plating layer 114.

Figure 9D:
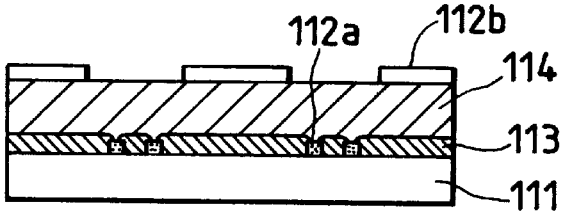

Next, as shown in FIG. 9D, for forming the second liquid flow paths, a resist 112*b* was formed on the second plating layer 114, and patterning by photolithography was carried out to remove the portions to become the second path portions.

Figure 9E:
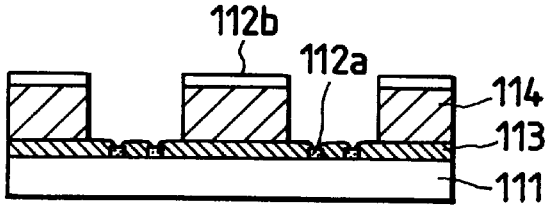

Then, as shown in FIG. 9E, exposed portions of the second plating layer 114 were etched using the etchant, either ferric chloride or the mixture solution of nitric acid, acetic acid, and acetone to form recesses in the depth of approximately 10 μm. These recesses become the second path portions 116. Since gold of the first plating layer is insoluble in the etchant, only the second plating layer is etched. Accordingly, the depth of the recesses to become the second path portions can be controlled by the thickness of the second plating layer, which permits high-accuracy formation of the second path portions.

Figure 9F:
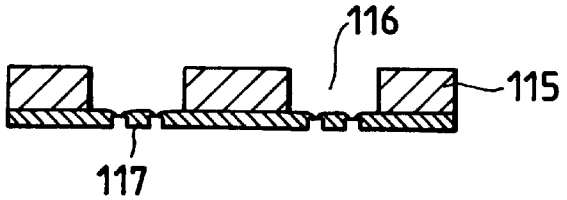

Finally, as shown in FIG. 9F, and the resists 112*a* and 112*b* were removed to form the second recesses 116 to become the second path portions and the movable members 117 in the partition wall and a plate member comprised of the first plating layer 113 and the second plating layer 114 was stripped off from the SUS substrate 111, thereby obtaining the nickel plate 115 that can be used as a partition wall.

Since the present example allows an expensive metal with a small Young's modulus to be used as a material for forming the movable members 117 in the partition wall 115 obtained by electroforming of two types of metals, the durability can be improved.

(Example 4)

Figure 10A:
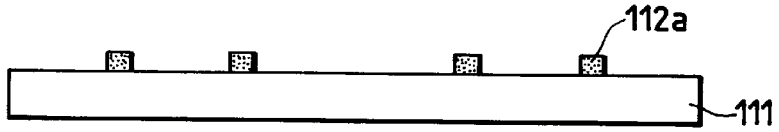
FIGS. 10A to 10E are explanatory drawings to show steps for producing the partition wall in Embodiment 4 of the present invention.

FIGS. 10A to 10E are schematic, sectional views to show steps for forming the partition wall as an example for integrally forming the side walls of second path portions and the movable members in the partition wall by electroforming and dry film. First, as shown in FIG. 10A, the portions corresponding to the slit portions of the movable members were formed on the SUS substrate 111 in the same manner as in Example 3. The width of the resist 112*a* for forming the slit portions can be arbitrarily determined within the range of 0.5 to 1 μm.

Figure 10B:
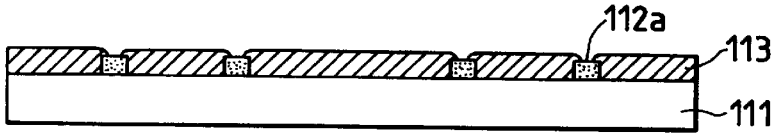
Figure 10C:
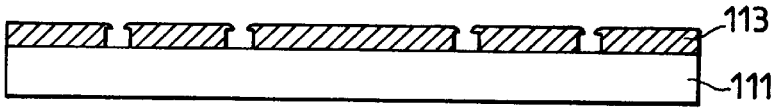

Then, as shown in FIG. 10B, electroplating was carried out to grow a nickel layer 5 μm thick as a first plating layer 113 in exposed portions of the substrate 111. The plating solution used was the one containing nickel sulfonate, a stress decrease material ZERO ALL (registered trade name, available from WORLD METAL INC.), boric acid, a pit prevention material NSAPS (trade name, available from WORLD METAL INC.), and nickel chloride. The electric field upon electrodeposition was established under such conditions that the electrode was connected to the anode, the SUS substrate 111 already patterned was connected to the cathode, the temperature of the plating solution was controlled at 50° C., and the current density was 5 A/dm$^2$. The first plating layer 113 thus formed on the substrate 111 by electroplating comprises a plate member 113*a* for forming the partition wall, and the movable members 113*b* in the cantilever beam shape separated by the predetermined slit from the plate member 113*a*.

Figure 10D:
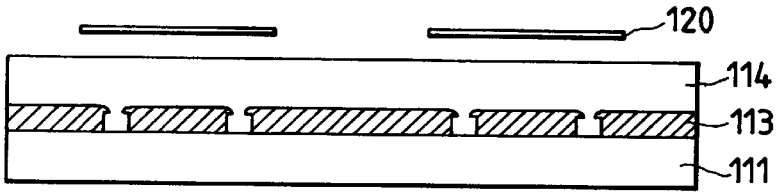

Next, as shown in FIG. 10D, a dry film 114 10 μm thick was placed on the electroformed surface, and patterning by photolithography was carried out to form recesses to become the second path portions.

Figure 10E:
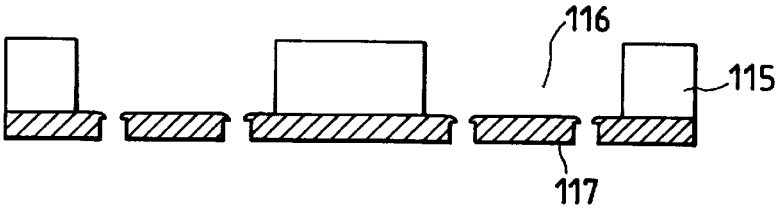

Then, as shown in FIG. 10E, and the resists 112*a* and 112*b* were removed therefrom to form the second recesses 116 to become the second path portions and the movable members 117 in the partition wall and the plate member comprised of the first plating layer 113 and the dry film 114 was stripped off from the SUS substrate 111, thus obtaining the plate 115 made of nickel and resin, which can be used as a partition wall.

Since in this example the side walls of the second path portions can be produced by patterning of the dry film, the partition wall can be produced easier than in Example 1. Since the nickel plate and the dry film are adhered to each other by adhesion of the dry film itself, no gap will appear between the partition wall portion and the portions of side walls of second path portions.

Since in this example the slits for movable members 117 are formed by electroforming similarly as in Example 1, the slit width can be precisely controlled within the predetermined range and the thickness of the partition wall 15 can be uniformly controlled.

(Example 5)

Examples 1 to 4 showed the methods for producing the slit portions by electroforming, whereas the present example shows an example for forming the slits by laser.

FIGS. 11A to 11D are schematic, sectional views to show steps for producing the partition wall as an example for integrally forming the side walls of the second path portions and the movable members in the partition wall by forming the slit portions with laser and forming the second path portions by etching.

Figure 11A:
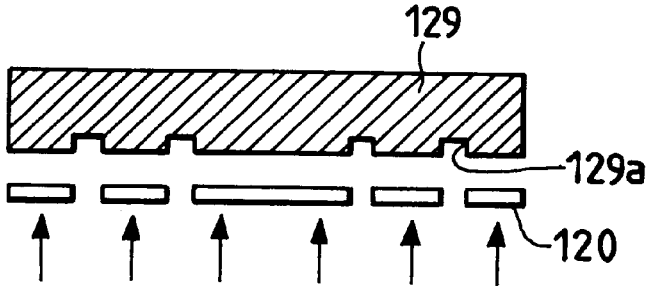
FIGS. 11A to 11D are explanatory drawings to show steps for producing the partition wall in Embodiment 5 of the present invention.

First, as shown in FIG. 11A, a nickel plate 129 15 μm thick to become a partition wall was prepared, and a mask 120 having slits in the width corresponding to the width of the slit between the partition wall and the movable member was located relative to the nickel plate 129. After that, irradiation with YAG laser was carried out to form fine recesses 119*a*. A laser irradiating apparatus used was LU100 available from Hitachi Kenki, and the irradiation was carried out for one second at the pulse energy of 5 J/cm$^2$, the pulse width of 1 ms, and 300 Hz. The mask 120 used may be a perforated mask of nickel or a glass mask.

Figure 11B:
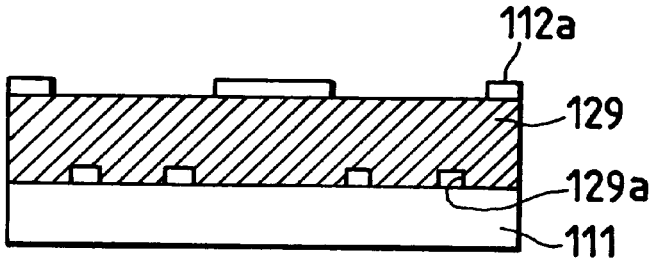

Next, as shown in FIG. 11B, the SUS substrate 111 was joined to the laser-irradiated surface of the nickel plate 129, and thereafter, for forming the second path portions on the surface opposite thereto, a coating of resist 112*a* 2 μm thick was formed by the photolithography technology and portions to become the second path portions were removed by patterning by photolithography.

Figure 11C:
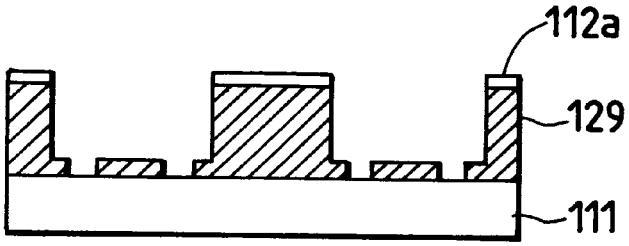

Then, as shown in FIG. 11C, etching was effected in the depth of approximately 10 μm to form the second recesses to become the second path portions in the exposed portions of the nickel plate 129. The etchant used was ferric chloride or the mixture solution of nitric acid, acetic acid, and acetone.

Figure 11D:
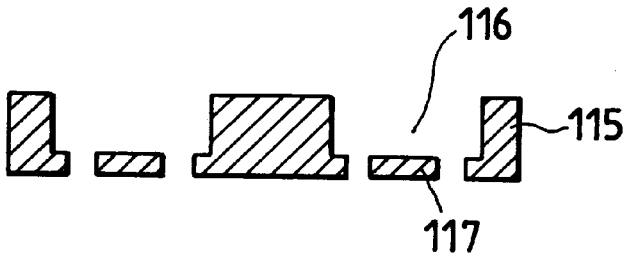

Then, as shown in FIG. 11D, the resist 112*a* was removed to and the laser-irradiated surface of the nickel plate 129 was stripped off from the SUS substrate 111 and form the second recesses 116 to become the second path portions and the movable members 117 in the partition wall, thereby obtaining the nickel plate 115 that can be used as a partition wall.

The material for forming the partition wall in the present example may be selected from copper, brass, molybdenum, niobium, titanium, tungsten, or alloys thereof, which can be well processed, in addition to nickel. The present example permits a resin to be used as a material for forming the partition wall, for example plastics such as ABS, polysulfone, polycarbonate, polyacetal, liquid crystal polymer, and so on, which can be processed well. However, because it is difficult to etch the resins, though processing with laser is easy therewith, it is preferred to process both the second path portions and movable members with laser.

Since the present example used the laser and etching for processing, the partition wall 115 can be easily produced in the precise dimension. The present example also permits the resin to be used as a material for the partition wall.

(Example 6)

FIGS. 12A to 12D are schematic, sectional views to show steps for producing the partition wall as an example for integrally forming the side walls of the second path portions and the movable members in the partition wall by forming the slit portions with laser and forming the second path portions by etching.

Figure 12A:
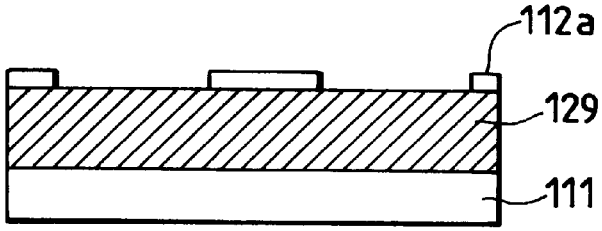
FIGS. 12A to 12D are explanatory drawings to show steps for producing the partition wall in Embodiment 6 of the present invention.

First, as shown in FIG. 12A, a nickel plate 129 15 μm thick to become the partition wall was prepared, and the SUS substrate 111 was joined to the bottom surface of the nickel plate 129. After that, for forming the second path portions on the surface opposite thereto, a coating of resist 112*a* 2 μm thick was formed by the photolithography technology, and patterning by photolithography was carried out to remove the portions to become the second path portions.

Figure 12B:
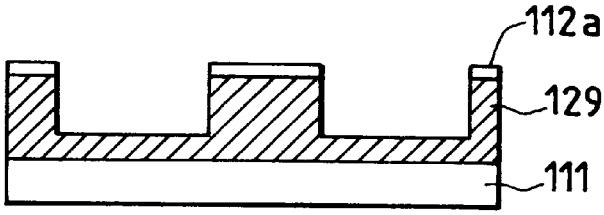

Then, as shown in FIG. 12B, etching was conducted in the depth of approximately 10 μm to form the second recesses to become the second path portions in the exposed portions of the nickel plate 129. The etchant used was ferric chloride or the mixture solution of nitric acid, acetic acid, and acetone. The nickel plate 129 was stripped off from the SUS substrate 111.

Figure 12C:
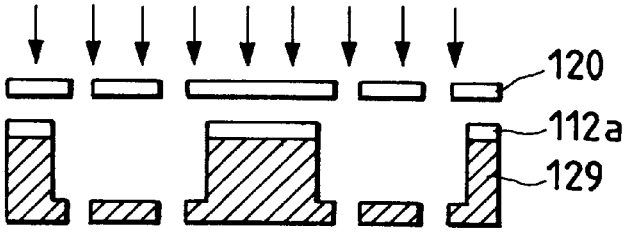

Then, as shown in FIG. 12C, a mask 120 having slits in the width corresponding to the width of the slit between the partition wall and the movable member was located relative to the top surface of the nickel plate 129, and thereafter irradiation with YAG laser was carried out through the slits in the mask 120 to form the movable members 117 in the cantilever beam shape and in the above slit width in the bottom parts of the second recesses in the nickel plate 129. The laser irradiating apparatus used was LU100 available from Hitachi Kenki, and the irradiation was carried out for one second at the pulse energy of 5 J/cm$^2$, the pulse width of 1 ms, and 300 Hz. The mask 120 used may be a perforated mask of nickel or a glass mask.

Figure 12D:
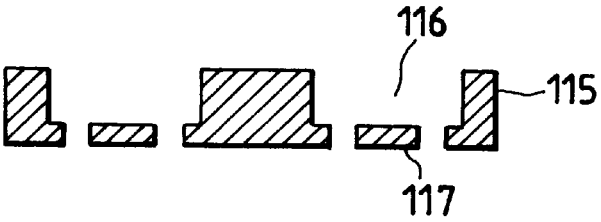

Next, as shown in FIG. 12D, the substrate 111 was stripped off from the bottom surface of the nickel plate 129, and the resists 112*a* and 112*b* were removed to form the second recesses 116 to become the second path portions and the movable members 117 in the partition wall, thereby obtaining the nickel plate 115 that can be used as a partition wall.

Since this example used the laser and etching for processing, the partition wall 115 can be easily produced in the precise dimension.

(Example 7)

FIGS. 13A to 13D are schematic, sectional views to show steps for producing the partition wall as an example for integrally forming the second liquid flow paths, the movable members in the partition wall, and the grooves for positioning the first liquid flow paths by using the matrix and performing electroforming and laser processing.

Figure 13A:
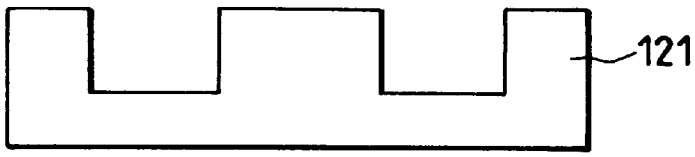
FIGS. 13A to 13D are explanatory drawings to show steps for producing the partition wall in Embodiment 7 of the present invention.
Figure 13B:
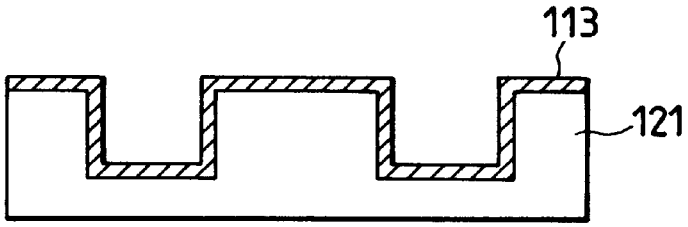

First, as shown in FIG. 13A, the matrix 121 produced in the same method as in Example 2 was prepared, and then, as shown in FIG. 13B, electroplating was carried out in the same manner as in Example 1 to form a nickel plating layer 113 approximately 5 $\mu$m thick over the top surface of the matrix 121 and the inner surfaces of first recesses.

Figure 13C:
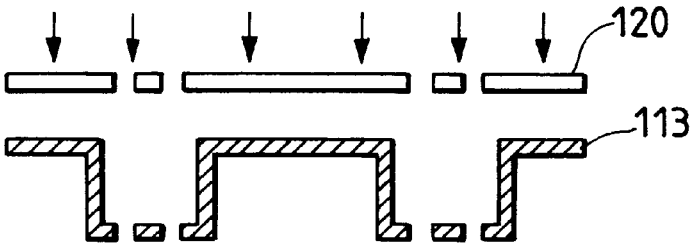
Figure 13D:
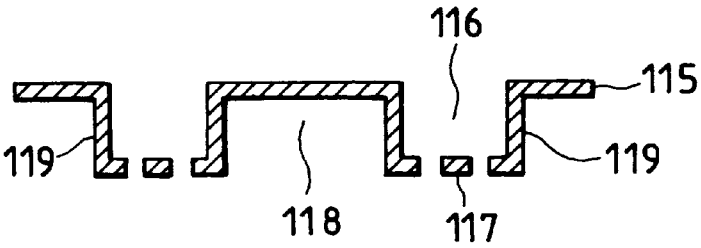

Then the nickel plate of the plating layer 113 was stripped off from the matrix 121, and, as shown in FIG. 13C, a mask 120 having slits in the width corresponding to the width of the slit between the partition wall and the movable member was placed relative to the plating layer 113 of the matrix 121. After that, irradiation with YAG laser was carried out in the same manner as in Example 5 through the slits of the mask 120 to form the portions to become the movable members in the cantilever beam shape in the bottom portion of the plating layer 113.

Formed in this manner were the second path portions 116, the movable members 117 in the partition wall, and the grooves 119 for positioning the walls of the first path portions, thereby obtaining the nickel plate 115 that can be used as a partition wall.

Since this example uses the matrix similarly as in Example 2, the number of steps can be reduced. Since the nickel plate to become the partition wall 115 is produced by electroforming, the thickness of the partition wall 115 can also uniformly be controlled.

<Ejection liquid and bubble generation liquid>

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

The liquid ejecting head obtained according to either one of the methods in the above examples permits use of different liquids as an ejection liquid and as a bubble generation liquid and can eject the ejection liquid by the pressure raised with generation of a bubble in the bubble generation liquid. With the conventional liquid ejecting heads, a high-viscosity liquid such as polyethylene glycol did not show sufficient bubble generation even with application of heat and had insufficient ejection force. In contrast with it, the liquid ejecting head of the present invention can eject such a high-viscosity liquid well in such a manner that the high-viscosity liquid is supplied to the first liquid flow path and a liquid easy to generate a bubble (a mixture solution of ethanol and water at 4:6 having the viscosity of approximately 1–2 cP or the like) is supplied as a bubble generation liquid to the second liquid flow path. Further, since the structure of the liquid ejecting head of the present invention involves the effects as explained in the foregoing examples, the high-viscosity liquid can be ejected at further high ejection efficiency and high ejection pressure.

In the case of a liquid weak against heat being used, if this liquid is supplied as an ejection liquid to the first liquid flow path and a liquid easy to generate a bubble and resistant to heat is supplied to the second liquid flow path, the liquid can be ejected at the high ejection efficiency and high ejection pressure without thermally damaging the liquid weak against heat.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

Dye ink viscosity of 2 cp (C.I. food black 2) dye 3 wt. % diethylene glycol 10 wt. %

Thio diglycol 5 wt. %

Ethanol 3 wt. %

Water 77 wt. %

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image. Bubble generation liquid 1:

| | |
|---|---|
| Ethanol | 40 wt. % |
| Water | 60 wt. % |
| Bubble generation liquid 2: | |
| Water | 100 wt. % |
| Bubble generation liquid 3: | |
| Isopropyl alcoholic | 10 wt. % |
| Water | 90 wt. % |
| Ejection liquid 1: | |
| (Pigment ink approx. 15 cps) | 5 wt. % |
| Carbon black | |
| Stylene-acrylic acid-acrylate ethyl copolymer (oxide 140, weight average molecular weight 8,000) | |
| Mono-ethanol amine | 0.25 wt. % |
| Glycerin | 69 wt. % |
| Thiodiglycol | 5 wt. % |
| Ethanol | 3 wt. % |
| Water | 16.75 wt. % |
| Ejection liquid 2 (55 cps): | |
| Polyethylene glycol 200 | 100 wt. % |
| Ejection liquid 3 (150 cps): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

<Liquid ejection head cartridge>

The description will be made as to a liquid ejection head cartridge having a liquid ejecting head according to an embodiment of the present invention.

Figure 14:
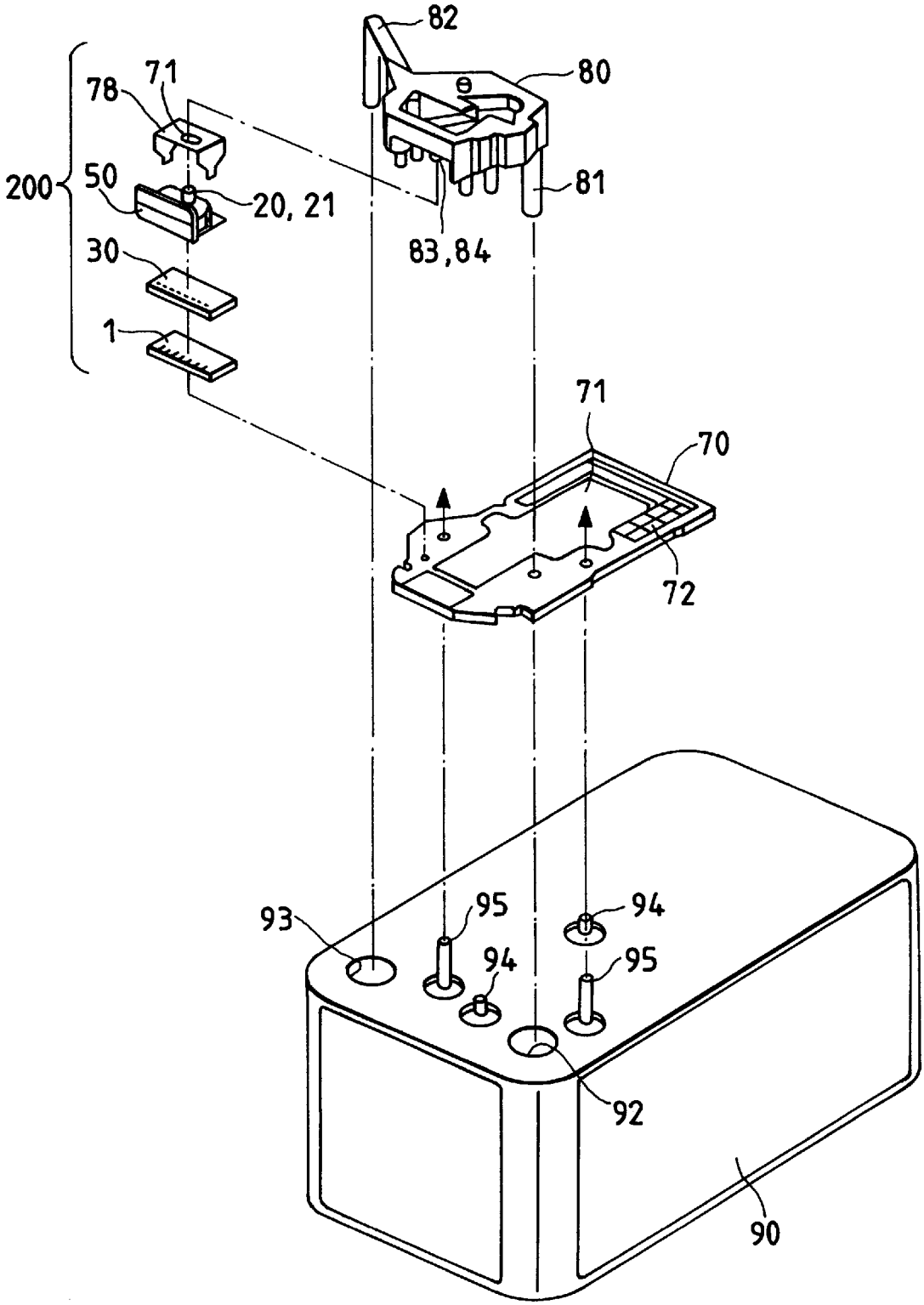
FIG. 14 is a schematic, exploded, perspective view of a liquid ejecting head cartridge incorporating the liquid ejecting head of the present invention.

FIG. 14 is a schematic exploded perspective view of a liquid ejection head cartridge including the above-described liquid ejecting head, and the liquid ejection head cartridge comprises generally a liquid ejecting head portion 200 and a liquid container 80.

The liquid ejecting head portion 200 comprises an element substrate 1, a separation wall 30, a grooved member 50, a confining spring 78, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 78 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 81 of the connecting member from the ejection liquid supply passage 92 of the liquid container, and is supplied to a first common liquid chamber through the ejection liquid supply passage 83, supply and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members.

In such a liquid ejection head cartridge, even if the bubble generation liquid and the ejection liquid are different liquids, the liquids are supplied in good order. In the case that the ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and liquid container may be unseparably integral, or may be separable.

<Liquid ejecting device>

Figure 15:
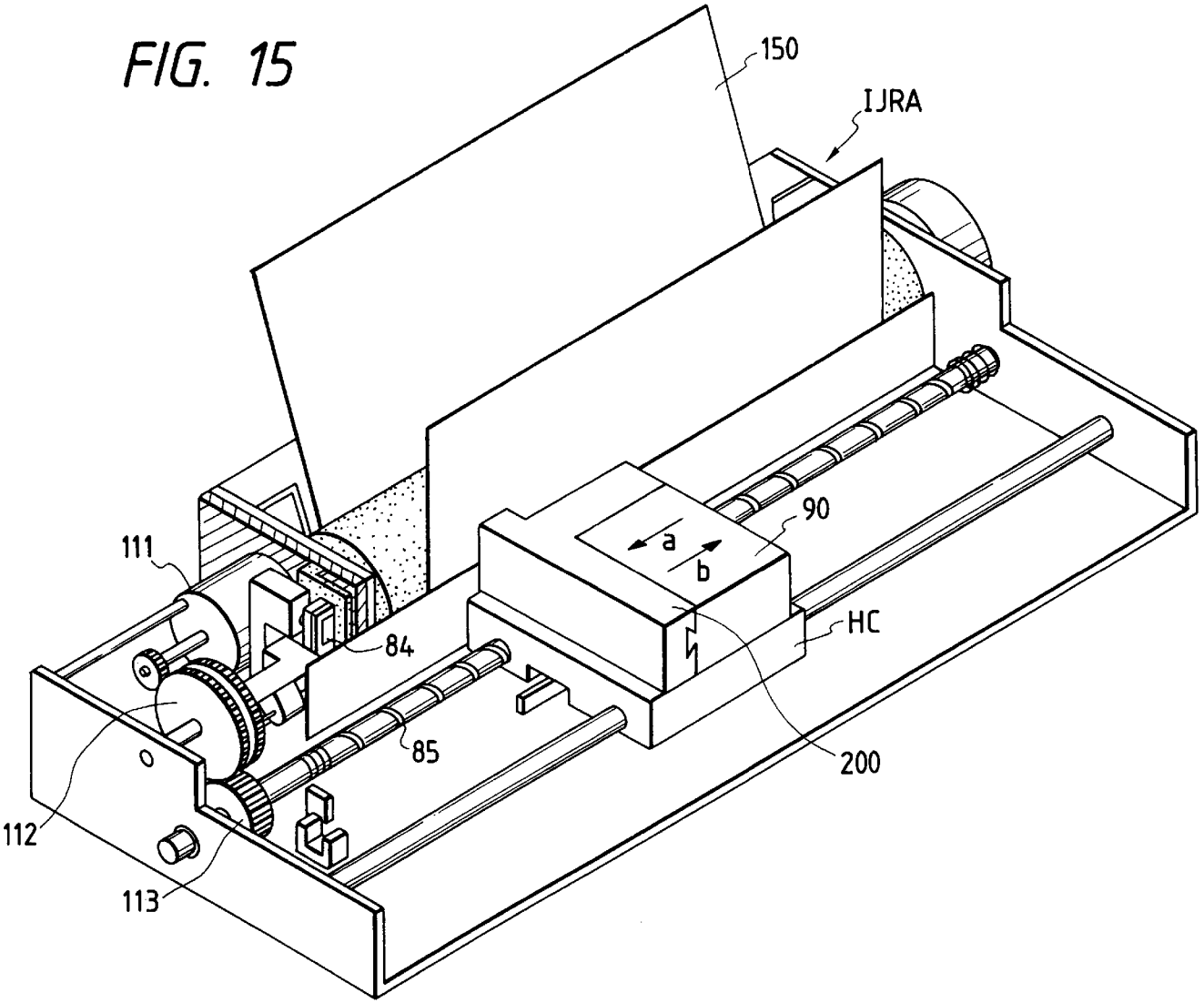
FIG. 15 is a schematic drawing of a liquid ejecting apparatus incorporating the liquid ejecting head of the present invention.

FIG. 15 is a schematic illustration of a liquid ejecting device used with the above-described liquid ejecting head. In this embodiment, the ejection liquid is ink, and the apparatus is an ink ejection recording apparatus. The liquid ejecting device comprises a carriage HC to which the head cartridge comprising a liquid container portion 90 and liquid ejecting head portion 200 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head in response to the signal.

The liquid ejecting apparatus of this embodiment comprises a motor 111 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material.

Figure 16:
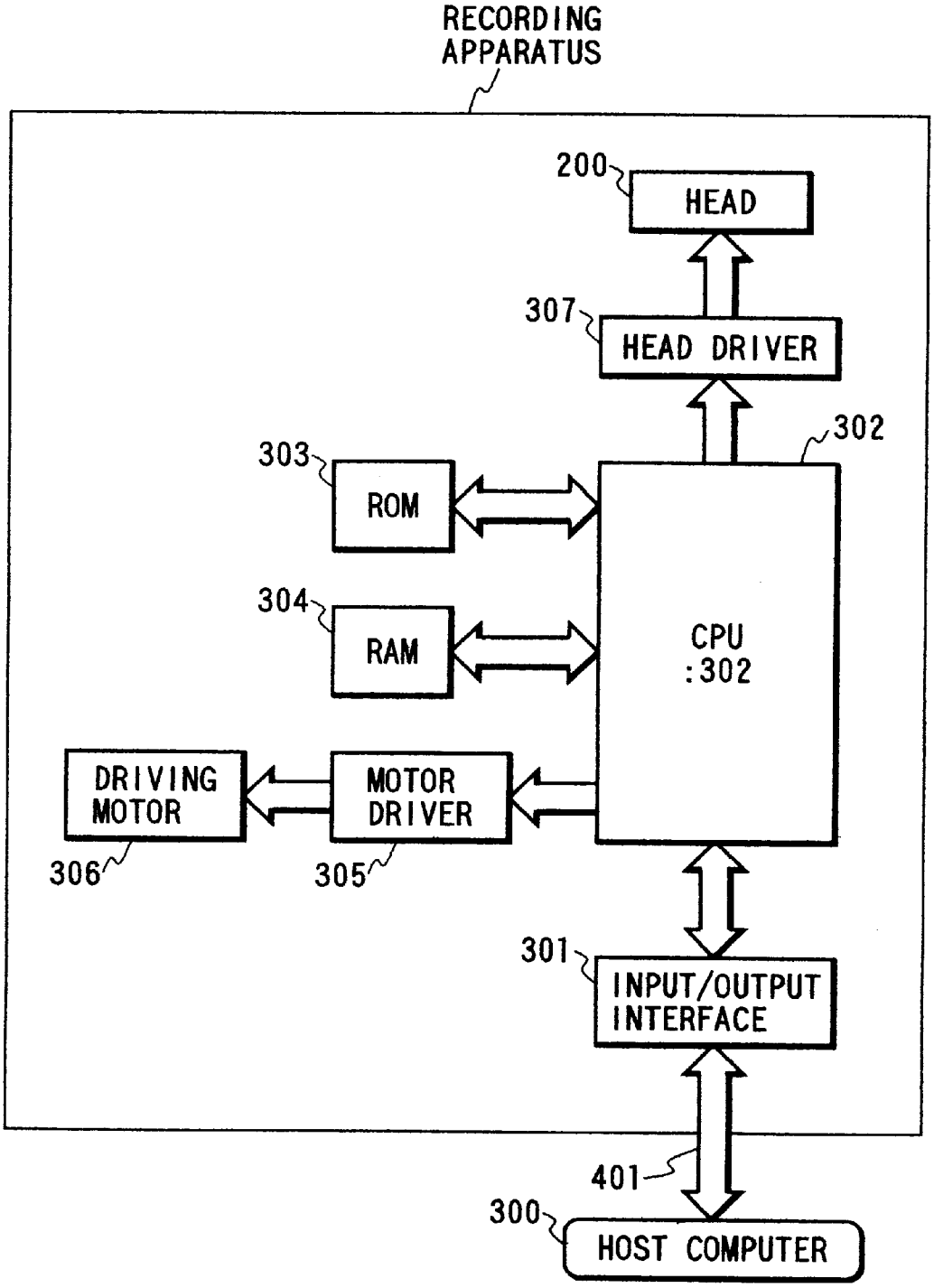
FIG. 16 is a block diagram of the whole of an apparatus for operation of ink ejection recording utilizing the liquid ejecting method and liquid ejecting head applicable to the present invention.

FIG. 16 is a block diagram for describing the general operation of an ink ejection recording apparatus which employs the liquid ejection method, and the liquid ejection head, in accordance with the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional net-like recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

<Recording System>

Next, an exemplary ink jet recording system will be described, which records images on recording medium, using, as the recording head, the liquid ejection head in accordance with the present invention.

Figure 17:
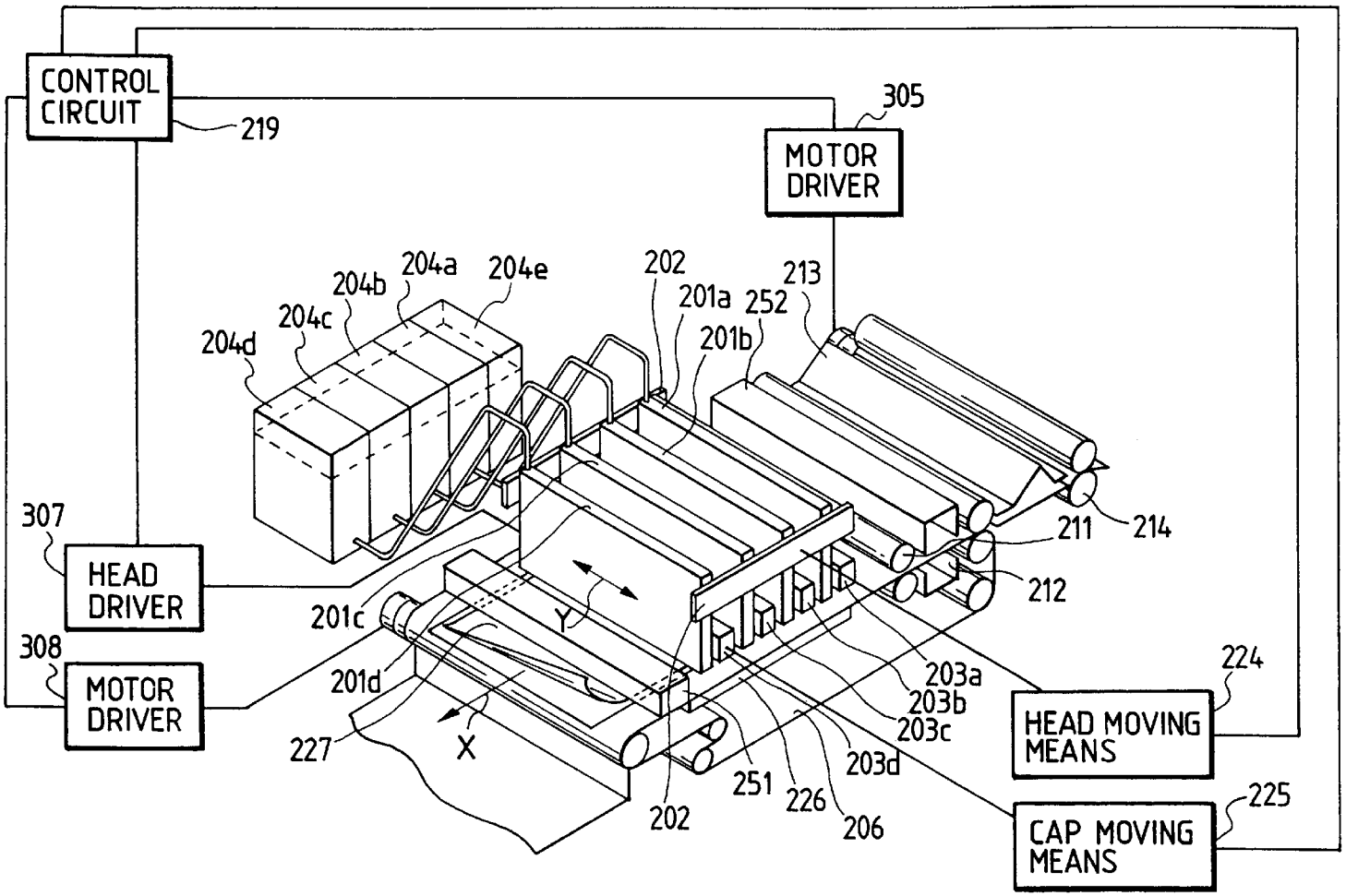
FIG. 17 is a schematic, perspective view for explaining the structure of an ink jet recording system using the liquid ejecting head of the present invention.

FIG. 17 is a schematic perspective view of an ink jet recording system employing the aforementioned liquid ejection head 201 in accordance with the present invention, and depicts its general structure. The liquid ejection head in this embodiment (p.58) is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 204*a,* 204*b,* 205*c* or 204*d.* A reference numeral 204*e* designates a bubble generation liquid container from which the bubble generation liquid is delivered to each head.

Below each head, a head cap 203*a,* 203*b,* 203*c* or 203*d* is disposed, which contains an ink absorbing member composed of sponge or the like. They cover the ejection orifices of the corresponding heads, protecting the heads, and also maintaining the head performance, during a non-recording period.

A reference numeral 206 designates a conveyer belt, which constitutes means for conveying the various recording medium such as those described in the preceding embodiments. The conveyer belt 206 is routed through a predetermined path by various rollers, and is driven by a driver roller connected to a motor driver 305.

The ink jet recording system in this embodiment comprises a pre-printing processing apparatus 251 and a post-printing processing apparatus 252, which are disposed on the upstream and downstream sides, respectively, of the ink jet recording apparatus, along the recording medium conveyance path. These processing apparatuses 251 and 252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultra-violet rays and ozone before printing, activating its surface. In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

<Head Kit>

Figure 18:
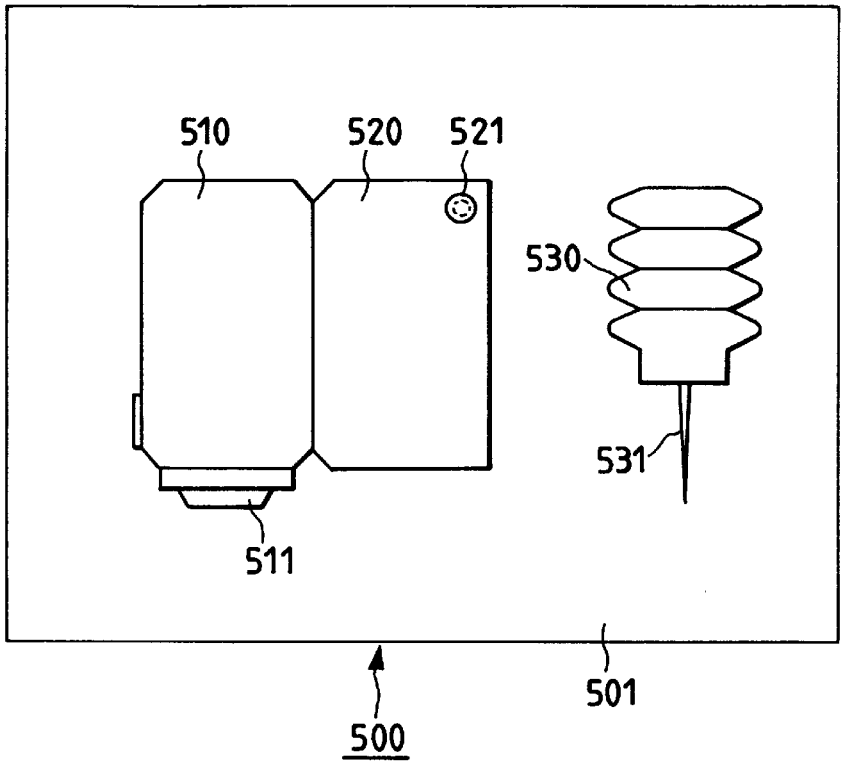
FIG. 18 is a schematic plan view to show a head kit having the liquid ejecting head of the present invention.

Hereinafter, a head kit will be described, which comprises the liquid ejection head in accordance with the present invention. FIG. 18 is a schematic view of such a head kit. This head kit is in the form of a head kit package 501, and contains: a head 510 in accordance with the present invention, which comprises an ink ejection section 511 for ejecting ink; an ink container 510, that is, a liquid container which is separable, or nonseparable, from the head; and ink filling means 530, which holds the ink to be filled into the ink container 520.

After the ink in the ink container 520 is completely depleted, the tip 530 (in the form of a hypodermic needle or the like) of the ink filling means is inserted into an air vent 521 of the ink container, the junction between the ink container and the head, or a hole drilled through the ink container wall, and the ink within the ink filling means is filled into the ink container through this tip 531.

When the liquid ejection head, the ink container, the ink filling means, and the like are available in the form of a kit contained in the kit package, the ink can be easily filled into the ink depleted ink container as described above; therefore, recording can be quickly restarted.

In this embodiment, the head kit contains the ink filling means. However, it is not mandatory for the head kit to contain the ink filling means; the kit may contain an exchangeable type ink container filled with the ink, and a head.

Even though FIG. 32 illustrates only the ink filling means for filling the printing ink into the ink container, the head kit may contain means for filling the bubble generation liquid into the bubble generation liquid container, in addition to the printing ink refilling means.

Figure 19:
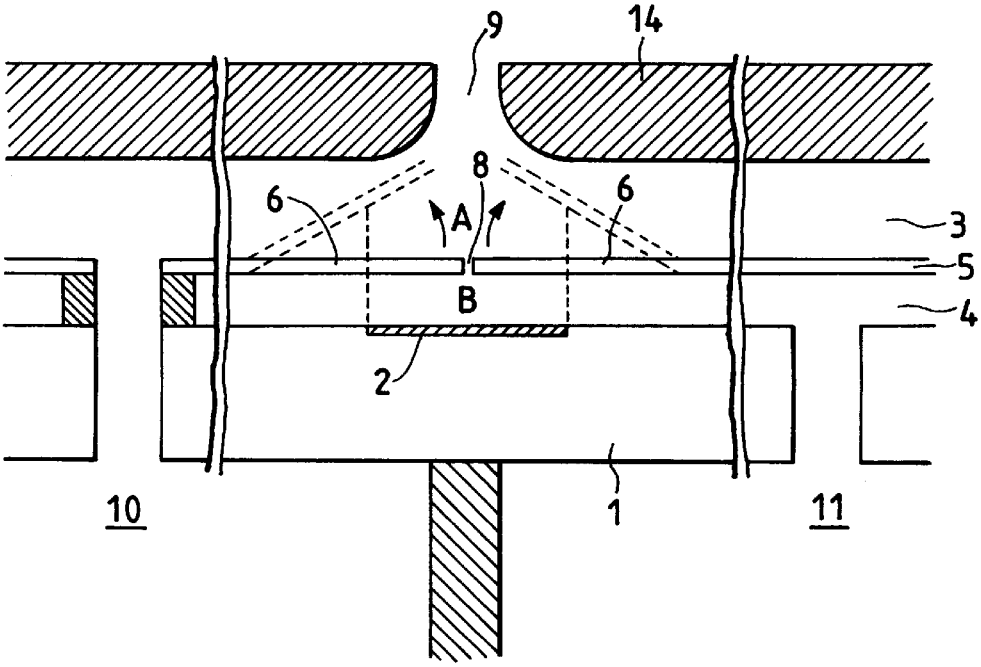
FIG. 19 is a sectional view to show the major structure of a head of a side shooter type as an example of the liquid ejecting head according to the present invention.

The present invention can be applied to the liquid ejecting heads as described above, including not only the heads of the so-called edge shooter type having an ejection outlet at one end of the liquid flow path in the direction along the surface of the heat generating element 2 as shown in FIG. 1, but also the heads of the so-called side shooter type having an ejection outlet on the side opposite to the surface of the heat generating element 2, for example, as shown in FIG. 19. Namely, the liquid ejecting head of the side shooter type can also be produced through the production steps, for example, shown in the foregoing examples.

The liquid ejecting head of the side shooter type shown in FIG. 19 is similar to the liquid ejecting head of the edge shooter type as described above in that, for each ejection outlet, a first path portion 4 in a bottom surface of which a heat generating element is positioned is formed on a substrate 1 provided with the heat generating element 2 for giving thermal energy for generating a bubble to the liquid, a second path portion 3 in direct fluid communication with the ejection outlet 9 is formed above it, a partition wall 5 made of a material having elasticity, such as a metal or the like, is provided between the second path portion 3 and the first path portion 4, and the liquid in the second path portion 3 is separated from the liquid in the first path portion 4 by the partition wall 5.

The liquid ejecting head of the side shooter type is characterized in that the ejection outlet 9 is provided in the portion immediately above the heat generating element 2, in the orifice plate 14 positioned above the second path portion 3. The partition wall 5 between the ejection outlet 9 and the heat generating element 2 is provided with a pair of movable members 6 which open like a double-leafed hinged door. Namely, the two movable members 6 are formed each in a cantilever beam shape with their free ends facing each other as being sightly separated by a slit 8 located immediately below the central portion of the ejection outlet 9 during a period without ejection. During a period of ejection, the two movable members 6 open to the side of the second path portion by bubble generation of the liquid in the region B generating the bubble, as shown by the arrows in FIG. 19. They are closed by contraction of the liquid. This region A is refilled with the liquid supplied from an ejection liquid tank described below to get into an ejection-ready state, thereby preparing for next bubble generation of the liquid.

The second path portion 3, together with the second path portions of other ejection outlets 9, is in communication with a tank (not shown) for reserving the ejection liquid through the second common liquid chamber 10, while the first path portion 4, together with the first path portions of other ejection outlets 9, is in communication with a tank (not shown) for reserving the liquid for generating the bubble through the first common liquid chamber 11.

The liquid ejecting head of the side shooter type having the above structure can also achieve the excellent effect that the liquid can be ejected at high ejection energy efficiency and high ejection pressure as improving refilling of the liquid ejected, almost similarly as the head of the edge shooter type does.

What is claimed is:

1. A method for producing a liquid ejecting head having an ejection outlet for ejecting a liquid, a heat generating element for applying thermal energy to said liquid, a liquid flow path comprised of a first path portion in fluid communication with said ejection outlet and a second path portion disposed below said first path portion and provided with said heat generating element in a bottom surface thereof, a partition wall for partitioning said liquid flow path into said first path portion and second path portion, and a movable member in said partition wall disposed above said heat generating element and displaceable into the first path portion in accordance with a bubble generated in the liquid by said thermal energy, comprising the steps of:

preparing a conductive substrate;

providing a resist at a portion of the conductive substrate where a slit is to be formed;

forming a partition wall by electroforming on the portion of the substrate adjacent to the resist; and forming a plurality of movable members by peeling the partition wall from the substrate and removing the resist to thereby form the slit, wherein upon generation of said bubble the first path portion and the second path portion are in fluid communication with each other and said pressure is directed toward said ejection outlet by said movable member displaced to eject said liquid droplet.

2. A method for producing a liquid ejecting head having an ejection outlet for ejecting a liquid, a heat generating element for applying thermal energy to said liquid, a liquid flow path comprised of a first path portion in fluid communication with said ejection outlet and a second path portion disposed below said first path portion and provided with said heat generating element in a bottom surface thereof, a partition wall for partitioning said liquid flow path into said first path portion and second path portion, and a movable member in said partition wall disposed above said heat generating element and displaceable into said first path portion in accordance with a bubble generated in the liquid by said thermal energy, comprising the steps of:

preparing a conductive substrate;

providing a resist at a portion of the conductive substrate where a slit is to be formed;

forming a partition wall by electroforming on the portion of the substrate adjacent to the resist; and forming a plurality of movable members by peeling the partition wall from the substrate and removing the resist to thereby form the slit.

* * * * *

UNITED STATES PATENT AND TRADEMARK OFFICE

CERTIFICATE OF CORRECTION

PATENT NO. : 6,074,543

DATED : June 13, 2000

INVENTOR(S) : AYA YOSHIHIRO ET AL.

It is certified that error appears in the above-identified patent and that said Letters Patent is hereby corrected as shown below:

COLUMN 1:

Line 41, "With such" should read --Such--.

COLUMN 5:

Line 21, "produced" should read --produce--.

COLUMN 10:

Line 23, "liquid.) Therefore," should read --liquid.)
¶ Therefore,--.

COLUMN 17:

Line 56, "a" should read --α--.

COLUMN 26:

Line 13, "supply" (second occurrence) should be deleted.

UNITED STATES PATENT AND TRADEMARK OFFICE

CERTIFICATE OF CORRECTION

PATENT NO. : 6,074,543

DATED : June 13, 2000

INVENTOR(S) : AYA YOSHIHIRO ET AL.

It is certified that error appears in the above-identified patent and that said Letters Patent is hereby corrected as shown below:

COLUMN 29:

Line 45, "sightly" should read --slightly--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*